US008777771B2

(12) United States Patent
Bennett et al.

(10) Patent No.: US 8,777,771 B2
(45) **Date of Patent: *Jul. 15, 2014**

(54) INTERCHANGEABLE SHAFT SYSTEM

(75) Inventors: Thomas Orrin Bennett, Carlsbad, CA (US); Stephanie Bezilla, Carlsbad, CA (US); Charles E. Golden, Carlsbad, CA (US); Bradford Hughes Hartwell, Carlsbad, CA (US); Scott A. Knutson, Carlsbad, CA (US); Stephen S. Murphy, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/568,044

(22) Filed: Aug. 6, 2012

(65) Prior Publication Data

US 2012/0295733 A1 Nov. 22, 2012

Related U.S. Application Data

(60) Division of application No. 13/076,585, filed on Mar. 31, 2011, now Pat. No. 8,235,839, which is a continuation of application No. 12/560,931, filed on Sep. 16, 2009, now Pat. No. 7,997,997, which is a continuation-in-part of application No. 11/958,412, filed on Dec. 18, 2007, now Pat. No. 7,878,921, and a continuation-in-part of application No. 12/493,517, filed on Jun. 29, 2009, now Pat. No. 8,235,934, which is a continuation-in-part of application No. 12/336,748, filed on Dec. 17, 2008, now Pat. No. 7,874,934, which is a continuation-in-part of application No. 12/023,402, filed on Jan. 31, 2008, now Pat. No. 7,699,717.

(51) Int. Cl.
*A63B 53/02* (2006.01)

(52) U.S. Cl.
USPC ..... 473/307; 473/288; 473/246

(58) Field of Classification Search
USPC ..... 473/288, 245–248, 307
See application file for complete search history.

(56) References Cited

U.S. PATENT DOCUMENTS

| | | | |
|---|---|---|---|
| 782,955 | A | 2/1905 | Emens |
| 1,352,918 | A | 9/1920 | Rohbock |
| 1,540,559 | A | 6/1925 | Murphy |
| 1,623,523 | A | 4/1927 | Bourke |
| 1,918,583 | A | 7/1933 | Beau |
| 2,020,679 | A | 11/1935 | Fitzpatrick |
| 2,027,452 | A | 1/1936 | Rusing |
| 2,051,961 | A | 8/1936 | Mears |
| 2,067,556 | A | 1/1937 | Wettlaufer |

(Continued)

FOREIGN PATENT DOCUMENTS

| | | |
|---|---|---|
| EP | 535848 A1 | 4/1993 |
| GB | 751323 | 6/1956 |

(Continued)

*Primary Examiner* — Stephen L. Blau
(74) *Attorney, Agent, or Firm* — Michael J. Mancuso

(57) ABSTRACT

A golf club incorporating an interchangeable shaft system includes a shaft, a shaft sleeve, a club head. The shaft sleeve is coupled to an end of the shaft and is received in a hosel included in the club head. The shaft sleeve is removably coupled to the club head. Hosel and shaft sleeve alignment features provide discreet orientations between the shaft and club head.

12 Claims, 27 Drawing Sheets

(56) References Cited

U.S. PATENT DOCUMENTS

| | | | | |
|---|---|---|---|---|
| 2,146,321 | A | 2/1939 | Wettlaufer | |
| 2,219,670 | A | 10/1940 | Wettlaufer | |
| 2,326,495 | A | 8/1943 | Reenstierna | |
| 2,361,415 | A | 10/1944 | Reach | |
| 2,425,808 | A | 8/1947 | Jakosky | |
| 2,770,161 | A | 11/1956 | Schutte | |
| 2,882,053 | A | 4/1959 | Lorthiois | |
| 2,962,286 | A | 11/1960 | Brouwer | |
| 3,087,371 | A | 4/1963 | Orner | |
| 3,170,691 | A | 2/1965 | Pritchard | |
| 3,422,721 | A | 1/1969 | Yonkers | |
| 3,524,646 | A | 8/1970 | Wheeler | |
| 3,595,577 | A | 7/1971 | Hodge | |
| 3,625,517 | A | 12/1971 | Durnack | |
| 3,685,135 | A | 8/1972 | Letters | |
| 3,788,185 | A | 1/1974 | Gutshall | |
| 3,810,631 | A | 5/1974 | Braly | |
| 3,840,231 | A | 10/1974 | Moore | |
| 4,222,567 | A | 9/1980 | Shabala | |
| 4,253,666 | A | 3/1981 | Murphy | |
| 4,362,449 | A | 12/1982 | Hlinsky | |
| 4,664,382 | A | 5/1987 | Palmer et al. | |
| 4,852,782 | A | 8/1989 | Wu et al. | |
| 4,854,582 | A | 8/1989 | Yamada | |
| 4,943,059 | A | 7/1990 | Morell | |
| 4,948,132 | A | 8/1990 | Wharton | |
| 4,984,794 | A | 1/1991 | Pernelle et al. | |
| 5,039,098 | A | 8/1991 | Pelz | |
| 5,058,891 | A | 10/1991 | Takeuchi | |
| 5,133,553 | A | 7/1992 | Divnick | |
| 5,184,819 | A | 2/1993 | Desbiolles | |
| 5,326,206 | A | 7/1994 | Moore | |
| 5,433,442 | A | 7/1995 | Walker | |
| 5,527,034 | A | 6/1996 | Ashcraft et al. | |
| 5,538,245 | A | 7/1996 | Moore | |
| 5,540,435 | A | 7/1996 | Kawasaki | |
| 5,588,921 | A | 12/1996 | Parsick | |
| 5,634,857 | A | 6/1997 | Bradshaw et al. | |
| 5,722,901 | A | 3/1998 | Barron et al. | |
| 5,839,973 | A | 11/1998 | Jackson | |
| 5,851,155 | A | 12/1998 | Wood et al. | |
| 5,863,260 | A | 1/1999 | Butler, Jr. et al. | |
| 5,885,170 | A | 3/1999 | Takeda | |
| 5,906,549 | A | 5/1999 | Kubica | |
| 5,924,938 | A | 7/1999 | Hines | |
| 5,951,411 | A | 9/1999 | Wood et al. | |
| 6,050,903 | A | 4/2000 | Lake | |
| 6,089,991 | A | 7/2000 | Yeh | |
| 6,110,055 | A | 8/2000 | Wilson | |
| 6,183,375 | B1 | 2/2001 | Weiss | |
| 6,241,623 | B1 | 6/2001 | Laibangyang | |
| 6,251,028 | B1 | 6/2001 | Jackson | |
| 6,273,828 | B1 | 8/2001 | Wood et al. | |
| 6,341,690 | B1 | 1/2002 | Swiatosz | |
| 6,352,482 | B1 | 3/2002 | Jacobson et al. | |
| 6,368,230 | B1 | 4/2002 | Helmstetter et al. | |
| 6,475,100 | B1 | 11/2002 | Helmstetter et al. | |
| 6,547,673 | B2 | 4/2003 | Roark | |
| 6,620,053 | B2 | 9/2003 | Tseng | |
| 6,634,958 | B1 | 10/2003 | Kusumoto | |
| 6,669,573 | B2 | 12/2003 | Wood et al. | |
| 6,769,996 | B2 | 8/2004 | Tseng | |
| RE38,605 | E | 9/2004 | Kubica et al. | |
| 6,890,269 | B2 | 5/2005 | Burrows | |
| 6,966,847 | B2 | 11/2005 | Lenhof et al. | |
| 6,981,922 | B2 | 1/2006 | Lenhof et al. | |
| 7,083,529 | B2 | 8/2006 | Cackett et al. | |
| 7,115,046 | B1 | 10/2006 | Evans | |
| 7,226,364 | B2 | 6/2007 | Helmstetter | |
| 7,232,376 | B2 | 6/2007 | Droppleman | |
| 7,264,556 | B1 | 9/2007 | Divisconti | |
| 7,300,359 | B2 | 11/2007 | Hocknell et al. | |
| 7,344,449 | B2 | 3/2008 | Hocknell et al. | |
| 7,354,353 | B2 | 4/2008 | Hocknell et al. | |
| 7,427,239 | B2 | 9/2008 | Hocknell et al. | |
| 7,431,663 | B2 | 10/2008 | Pamias | |
| 7,530,900 | B2 | 5/2009 | Holt et al. | |
| 7,566,279 | B2 | 7/2009 | Nakashima | |
| 7,578,084 | B2 | 8/2009 | Wu | |
| 7,611,422 | B2 | 11/2009 | Hocknell et al. | |
| 7,628,707 | B2 | 12/2009 | Beach et al. | |
| 7,651,407 | B2 | 1/2010 | Tsai et al. | |
| 7,699,717 | B2 | 4/2010 | Morris et al. | |
| 7,704,156 | B2 | 4/2010 | Stites et al. | |
| 7,704,158 | B2 | 4/2010 | Burrows | |
| 7,722,474 | B2 | 5/2010 | Thomas et al. | |
| 7,722,475 | B2 | 5/2010 | Thomas et al. | |
| 7,789,766 | B2 | 9/2010 | Morris et al. | |
| 7,789,769 | B2 | 9/2010 | Sugimoto | |
| 7,850,410 | B1 | 12/2010 | Curtis | |
| 7,850,540 | B2 | 12/2010 | Sander et al. | |
| 7,878,921 | B2 | 2/2011 | Bennett et al. | |
| 7,883,430 | B2 | 2/2011 | Thomas et al. | |
| 7,887,431 | B2 | 2/2011 | Beach et al. | |
| 7,922,599 | B2 | 4/2011 | Yamamoto | |
| 7,931,542 | B2 | 4/2011 | Kusumoto | |
| 7,938,735 | B2 | 5/2011 | Lau | |
| 7,955,185 | B2 | 6/2011 | Thomas et al. | |
| 7,976,401 | B2 | 7/2011 | Sato et al. | |
| 7,980,959 | B2 | 7/2011 | Morris et al. | |
| 7,997,997 | B2 | 8/2011 | Bennett et al. | |
| 8,025,587 | B2 | 9/2011 | Beach et al. | |
| 8,025,589 | B2 | 9/2011 | Brinton et al. | |
| 8,029,383 | B2 | 10/2011 | Yamamoto | |
| 8,057,320 | B2 | 11/2011 | Bennett et al. | |
| 8,075,417 | B2 | 12/2011 | Thomas et al. | |
| 8,079,128 | B2 | 12/2011 | Sander et al. | |
| 8,083,606 | B2 | 12/2011 | Brady | |
| 8,083,608 | B2 | 12/2011 | Thomas et al. | |
| 8,105,178 | B2 | 1/2012 | Sander | |
| 8,133,130 | B2 | 3/2012 | Morris et al. | |
| 8,133,131 | B1 | 3/2012 | Bennett et al. | |
| 8,182,357 | B2 * | 5/2012 | Moore | 473/246 |
| 8,192,299 | B2 | 6/2012 | Sato et al. | |
| 8,235,835 | B2 | 8/2012 | Soracco | |
| 8,235,836 | B2 | 8/2012 | Soracco et al. | |
| 8,235,838 | B2 | 8/2012 | Burrows | |
| 8,303,431 | B2 | 11/2012 | Beach et al. | |
| 2001/0007835 | A1 | 7/2001 | Baron | |
| 2003/0148818 | A1 | 8/2003 | Myrhum et al. | |
| 2004/0018886 | A1 | 1/2004 | Burrows | |
| 2005/0049072 | A1 | 3/2005 | Burrows | |
| 2006/0163093 | A1 | 7/2006 | Kronenberger | |
| 2006/0287125 | A1 | 12/2006 | Hocknell et al. | |
| 2006/0293116 | A1 * | 12/2006 | Hocknell et al. | 473/305 |
| 2007/0117645 | A1 | 5/2007 | Nakashima | |
| 2008/0058114 | A1 | 3/2008 | Hocknell et al. | |
| 2008/0254909 | A1 | 10/2008 | Callinan et al. | |
| 2008/0280693 | A1 | 11/2008 | Chai | |
| 2009/0062029 | A1 | 3/2009 | Stites et al. | |
| 2009/0233728 | A1 | 9/2009 | Liou | |
| 2009/0286611 | A1 * | 11/2009 | Beach et al. | 473/246 |
| 2010/0035700 | A1 | 2/2010 | Yu et al. | |
| 2010/0041491 | A1 * | 2/2010 | Thomas et al. | 473/288 |
| 2010/0197423 | A1 * | 8/2010 | Thomas et al. | 473/307 |

FOREIGN PATENT DOCUMENTS

| | | |
|---|---|---|
| GB | 2207358 | 2/1989 |
| JP | 4156869 | 5/1992 |
| JP | 200042151 | 2/2000 |
| JP | 200642951 | 2/2006 |
| WO | WO 90/00424 A1 | 1/1990 |
| WO | WO 2004009186 | 1/2004 |
| WO | WO 2006/055386 A1 | 5/2006 |
| WO | WO 2009/032533 A1 | 3/2009 |
| WO | WO 2009/035345 | 3/2009 |
| WO | WO 2010/011510 A1 | 1/2010 |

* cited by examiner

INTERCHANGEABLE SHAFT SYSTEM

CROSS-REFERENCE TO RELATED APPLICATIONS

This application is a divisional of U.S. patent application Ser. No. 13/076,585, filed Mar. 31, 2011 now U.S. Pat. No. 8,235,839, which is a continuation of U.S. patent application Ser. No. 12/560,931, filed Sep. 16, 2009, now U.S. Pat. No. 7,997,997, which is a continuation-in-part of U.S. patent application Ser. No. 11/958,412, filed Dec. 18, 2007, now U.S. Pat. No. 7,878,921, and which is a continuation-in-part of U.S. patent application Ser. No. 12/493,517, filed Jun. 29, 2009 now U.S. Pat. No. 8,235,834, which is a continuation-in-part of U.S. patent application Ser. No. 12/336,748, filed Dec. 17, 2008, now U.S. Pat. No. 7,874,934, which is a continuation-in-part of U.S. patent application Ser. No. 12/023,402, filed Jan. 31, 2008, now U.S. Pat. No. 7,699,717, the contents of which are incorporated in their entireties by reference herein.

FIELD OF THE INVENTION

This invention generally relates to golf clubs, and more specifically to golf clubs having an improved connection between the shaft and club head that provides interchangeability and adjustability.

BACKGROUND OF THE INVENTION

In order to improve their game, golfers often customize their equipment to fit their particular swing. In the absence of a convenient way to make shafts and club heads interchangeable, a store or a business offering custom fitting must either have a large number of clubs with specific characteristics, or must change a particular club using a complicated disassembly and reassembly process. If, for example, a golfer wants to try a golf club shaft with different flex characteristics, or use a club head with a different mass, center of gravity, or moment of inertia, in the past it has not been practical to make such changes. Golf equipment manufacturers have been increasing the variety of clubs available to golfers. For example, a particular model of golf club may be offered in several different loft angles and lie angles to suit a particular golfer's needs. In addition, golfers can choose shafts, whether metal or graphite, and adjust the length of the shaft to suit their swing. Recently, golf clubs have emerged that allow shaft and club head components, such as adjustable weights, to be interchanged to facilitate this customization process.

One example is U.S. Pat. No. 3,524,646 to Wheeler for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange that contacts the upper end of the putter head shank when the putter head is coupled to the shaft. This design produces an unaesthetic bulge at the top of the shaft and another unaesthetic bulge at the bottom of the shaft.

Another example is U.S. Pat. No. 4,852,782 to Wu et al. for Equipment for Playing Golf. The Wu patent discloses a set of equipment for playing golf that includes a length adjustable shaft and a plurality of club heads that are designed for easy assembly and disassembly. A connecting rod is inserted into an end of the shaft and a pin retains the connecting rod within the shaft. A locking portion of the connecting rod is configured to extend into the neck of a club head and through a slot in the neck. After the locking portion is extended through the slot, the connecting rod is rotated relative to the club head so that the components are locked together. The neck also includes sloping end surfaces that are configured to guide the ends of the pin to adjacent stop surfaces during the relative rotation between the connecting rod and the club head.

Another example is U.S. Pat. No. 4,943,059 to Morell for a Golf Club Having Removable Head. The Morell patent discloses a putter golf club including a releasable golf club head and an elongated golf club shaft. The club head hosel has a plug containing a threaded axial bore. A threaded rod is retained on the connector portion of the shaft and is threaded into the axial bore of the plug of the club head for operatively connecting the shaft to the head.

Another example is U.S. Pat. No. 5,433,442 to Walker for Golf Clubs with Quick Release Heads. The Walker patent discloses a golf club in which the club head is secured to the shaft by a coupling rod and a quick release pin. The upper end of the coupling rod has external threads that engage the internal threads formed in the lower portion of the shaft. The lower end of the coupling rod, which is inserted into the hosel of the club head, has diametric apertures that align with diametric apertures in the hosel to receive the quick release pin.

Another example is U.S. Pat. No. 5,722,901 to Barron et al. for a Releasable Fastening Structure for Trial Golf Club Shafts and Heads. The Barron patent discloses a bayonet-style releasable fastening structure for a golf club and shaft. The club head hosel has a fastening pin in its bore that extends diametrically. The head portion of the shaft has two opposing "U" or "J" shaped channels. The head end portion of shaft fastens on the hosel pin through axial and rotary motion. A spring in the hosel maintains this fastenable interconnection, but allows manually generated, axially inward hosel motion for quick assembly and disassembly.

Another example is U.S. Pat. No. 5,951,411 to Wood et al. for a Hosel Coupling Assembly and Method of Using Same. The Wood patent discloses a golf club including a club head, an interchangeable shaft, and a hosel with an anti-rotation device. The hosel contains an alignment member with an angular surface that is fixed, by a stud, within the hosel bore. A sleeve secured on the shaft end forms another alignment arrangement element and is adapted to engage the alignment element disposed in the hosel bore. A capture mechanism disposed on the shaft engages the hosel to releasably fix the shaft relative to the club head.

Still another example is U.S. Pat. No. 6,547,673 to Roark for an Interchangeable Golf Club Head and Adjustable Handle System. The Roark patent discloses a golf club with a quick release for detaching a club head from a shaft. The quick release is a two-piece connector including a lower connector, which is secured to the hosel of the club head, and an upper connector, which is secured to the lower portion of the shaft. The upper connector has a pin and a ball catch that both protrude radially outward from the lower end of the upper connector. The upper end of the lower connector has a corresponding slot formed therein for receiving the upper connector pin, and a separate hole for receiving the ball catch. When the shaft is coupled to the club head, the lower connector hole retains the ball catch to secure the shaft to the club head.

Another example is U.S. Pat. No. 7,083,529 to Cackett et al. for a Golf Club with Interchangeable Head-Shaft Connections. The Cackett patent discloses a golf club that uses a sleeve/tube arrangement instead of a traditional hosel to connect the interchangeable shaft to the club head in an effort to reduce material weight and provide for quick installation. A mechanical fastener (screw) entering the club head through the sole plate is used to secure the shaft to the club head.

Another example is U.S. Pat. App. Publ. No. 2001/0007835 A1 to Baron for a Modular Golf Club System and Method. The Baron publication discloses a modular golf club including club head, hosel, and shaft. A hosel is attached to a shaft and rotation is prevented by complementary interacting surfaces, adhesive bonding or mechanical fit. The club head and shaft are removably joined together by a collet-type connection.

Other published patent documents, such as U.S. Pat. Nos. 7,300,359; 7,344,449; and 7,427,239 and U.S. Pat. App. Publ. No. 2006/0287125, disclose interchangeable shafts and club heads with anti-rotation devices located therebetween.

In some examples, the structure that allows the shaft and club head to be interchanged also provides an ability to adjust the characteristics of the golf club. An example is U.S. Pat. No. 4,948,132 to Wharton for a Golf Club. The Wharton patent describes a golf club that is assembled from a club head and a shaft assembly. The shaft assembly includes a lower end portion that defines an axis that is inclined with respect to a shaft. The lower end portion of the shaft assembly includes a cylindrical outer surface with fluting or spines that engage surface discontinuities in a hosel bore of the club head so that the shaft assembly may be located in different configurations relative to the club head.

Another example is U.S. Pat. No. 4,854,582 to Yamada for a Head Connecting Device in Golf Clubs. The Yamada patent discloses a golf club head that includes a shaft connected to the club head through a setting part, which is a sleeve having an inclined shaft bore. The patent describes how the setting part may be rotated to change the direction of the bore and the shaft so the direction of the head against the shaft varies.

Each of the Wharton and Yamada examples provide limited adjustability. In particular, each provides loft and lie orientations that form a perimetric formation that does not provide any interior positions within the perimeter. FIG. 43 illustrates the orientations provided by a known system having eight available relative positions between a shaft and a club head, with the shaft being inclined at approximately 1.25°. As is apparent from that illustration, no interior positions are provided which deleteriously limits the ability to fine tune the fit of the golf club.

There remains a need in the art for golf clubs with an improved connection that provides a more secure fit with improved adjustability and that is easier to manufacture.

SUMMARY OF THE INVENTION

The invention is directed to an interchangeable shaft system for a golf club. The inventive system provides interchangeability between a shaft and a club head that imparts minimal additional components and manufacturing difficulty. Several embodiments of the present invention are described below.

In an embodiment, a golf club includes a golf club head, an elongate shaft, and an interchangeable shaft system. The interchangeable shaft system releasably couples the shaft to the club head and is configured to provide dual angle adjustability. The interchangeable shaft system is configured to provide a rectangular-shaped matrix of loft angle and lie angle orientations.

In another embodiment, a golf club includes a golf club head, an elongate shaft, a shaft sleeve, a wedge member and a fastener. The golf club head includes a hosel and a plurality of hosel alignment features. The hosel defines a sleeve bore and the hosel alignment features are disposed adjacent a proximal end of the hosel. The shaft sleeve is coupled to a distal end portion of the shaft and includes a sleeve body and a plurality of sleeve alignment features. The wedge member includes a plurality of wedge alignment features and is interposed between the shaft sleeve and the hosel. The fastener releasably couples the shaft sleeve to the club head. The wedge member provides a wedge angle between the shaft sleeve and the hosel and the shaft sleeve provides a shaft angle between the shaft sleeve and the shaft.

In a further embodiment, a golf club includes a golf club head, an elongate shaft, a shaft sleeve, an extension member, and a fastener. The club head includes a hosel and a plurality of hosel alignment features. The hosel defines a sleeve bore and the hosel alignment features are disposed adjacent a proximal end of the hosel. The shaft sleeve is coupled to a distal end portion of the shaft and includes a sleeve body and a plurality of sleeve alignment features. The extension member includes a plurality of extension alignment features and is interposed between the shaft sleeve and the hosel. The extension member has a length that is between about 0.125 inch and about 3.0 inches and includes parallel end surfaces. The fastener releasably couples the shaft sleeve to the club head.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
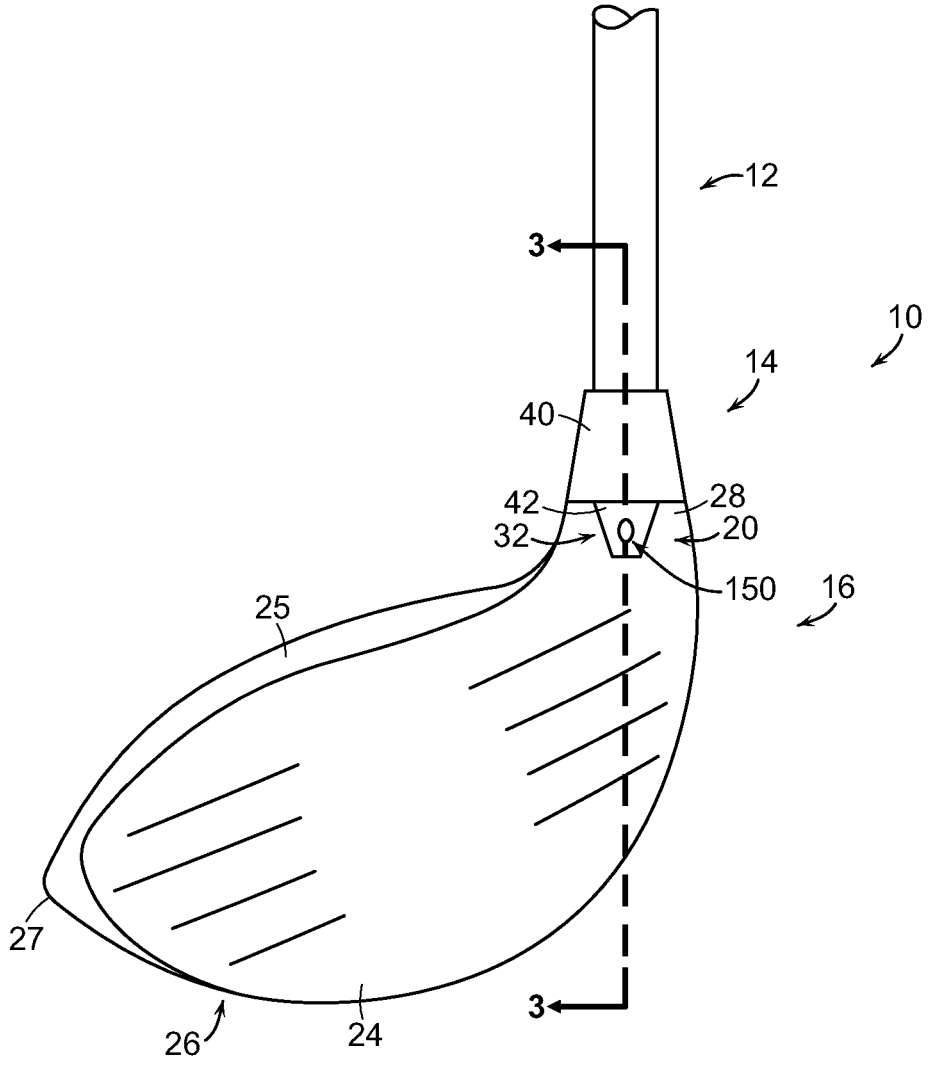
FIG. 1 is a side view of a portion of an exemplary golf club including an embodiment of the interchangeable shaft system of the present invention.

The present invention is directed to an interchangeable shaft system for connecting the shaft of a golf club to a club head. Such a system can be utilized to provide customized fitting of various shaft types to a club head and/or to provide adjustability between a shaft and a club head. Several embodiments of the present invention are described below.

Unless otherwise expressly specified, all of the numerical ranges, amounts, values and percentages such as those for amounts of materials, moments of inertias, center of gravity locations, loft and draft angles, and others in the following portion of the specification may be reads as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

A golf club incorporating an interchangeable shaft system 10 of the present invention generally includes a shaft 12, a shaft sleeve 14, a club head 16 and a fastener 18. Interchangeable shaft system 10 may be used by club fitters to repeatedly change shaft 12 and club head 16 combinations during a fitting session. The system permits fitting accounts maximum fitting options with an assembly of parts that is easy to use. In an embodiment, after a desired shaft 12 and club head 16 combination is selected, interchangeable shaft system 10 may be semi-permanently fixed so that disassembly by the average consumer is prevented. Alternatively, interchangeable shaft system 10 may be configured so that a consumer may manipulate the connection to replace shaft 12 or club head 16 and/or to provide adjustability between shaft 12 and club head 16.

As illustrated, the interchangeable shaft system of the present invention is incorporated into a driver style golf club. However it should be appreciated that the interchangeable shaft system of the present invention may be incorporated into any style of golf club. For example, the interchangeable shaft system may be incorporated into putters, wedges, irons, hybrids and/or fairway wood styles of golf clubs.

Club head 16 generally includes a face 24, a crown 25, a sole 26 and a skirt 27 that are combined to form the generally hollow club head 16. Club head 16 also includes hosel 20 that is a structure providing for a secure attachment between shaft 12 and club head 16 during manufacture of the golf club.

Shaft 12 may be any shaft known in the art. For example, shaft 12 may be constructed of metallic and/or non-metallic materials and shaft may be hollow, solid or a combination of solid and hollow portions.

Referring to FIGS. 1-5, interchangeable shaft system 10 connects shaft 12 to club head 16 so that different shafts 12 can be selectively connected to different club heads 16 via a hosel sleeve interface. Interchangeable shaft system 10 generally includes shaft sleeve 14 that is coupled to shaft 12 and at least partially received within hosel 20 of club head 16 and fastener 18 that releasably couples sleeve 14 to club head 16.

In the assembled interchangeable shaft system 10, a distal end portion 34 of shaft 12 is received within a shaft bore 36 of sleeve 14 and is securely attached thereto. Shaft 12 may be securely attached to sleeve 14 using any fastening method. For example, attachment methods such as welding, ultrasonic welding, brazing, soldering, bonding, mechanical fasteners, etc., may be employed. Adhesives such as epoxies or other similar materials may be utilized to securely fasten shaft 12 and sleeve 14. Preferably, end portion 34 is bonded within shaft bore 36 using an adhesive, such as epoxy. Alternatively, the features of shaft sleeve, such as a threaded portion and alignment features may be incorporated into the construction or co-molded with the shaft.

Sleeve 14 is inserted into hosel 20 in a selected orientation that assures that alignment features included on sleeve 14 and hosel 20 are engaged when the interchangeable shaft system is assembled. The orientation of the alignment features provides a desired relative position between shaft 12 and club head 16. Additionally, the engagement of the alignment features provides an anti-rotation feature that prevents relative rotation between sleeve 14 and hosel 20 about the longitudinal axis of hosel 20.

Hosel 20 is a generally tubular member that extends through, or from, crown 25 and at least a portion of club head 16. Hosel 20 defines a sleeve bore 30 that has a diameter selected so that a distal portion of sleeve 14 may be slidably received therein. Preferably, the diameter of sleeve bore 30 is selected so that there is minimal clearance between distal portion of sleeve 14 and hosel 20 to prevent relative lateral motion between sleeve 14 and hosel 20. Sleeve bore 30 terminates at a distal flange 31 which is located at a distal end of hosel 20. It should be appreciated, however, that the flange may be located at any intermediate position between the proximal and distal ends of the hosel.

In the present embodiment, a proximal end 28 of hosel 20 is disposed outward from club head 16 at a location spaced from crown 25 and includes at least one hosel alignment feature that extends through at least a portion of the sidewall of hosel 20. The hosel alignment feature provides at least one discrete alignment orientation between club head 16 and shaft 12 in the assembled golf club. In the present embodiment, hosel 20 includes alignment features in the form of a pair of notches 32 and each notch 32 extends through the sidewall of hosel 20 adjacent proximal end 28, i.e., each notch 32 extends from sleeve bore 30 to the outer surface of proximal end 28 of hosel 20.

Figure 6:
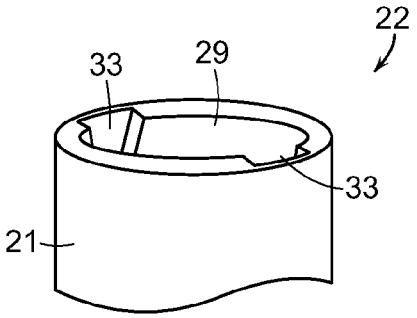
FIG. 6 is a perspective view of another embodiment of a proximal end portion of a hosel of a golf club having an interchangeable shaft system.

It should be appreciated that the hosel alignment feature need not extend entirely through the sidewall of the hosel and may extend through only a portion of the sidewall, as shown in the embodiment illustrated in FIG. 6. In particular, a proximal end portion 22 of a hosel 21 may include notches 33 that extend only through a portion of the sidewall of hosel 21. For example, notches 33 of the present embodiment include a generally trapezoidal cross-section similar to the previously described embodiment; however, notches 33 extend radially from sleeve bore 29 through a portion of the sidewall of proximal portion 22 of hosel 21 and do not intersect the outer surface of hosel 21. Such an embodiment may be preferred when it is desired to hide the alignment features from a user.

Notches 32 are diametrically opposed from each other in proximal end 28 at spaced locations about the proximal end of the generally tubular hosel 20. That configuration allows the combined shaft 12 and sleeve 14 to be coupled to club head 16 in two discrete positions rotated approximately 180° from each other. However, the hosel alignment features may be located in any desired position adjacent proximal end 28 of hosel 20 to provide any desired orientation between sleeve 14 and hosel 20. Although the present invention includes a pair of hosel alignment features, any number of hosel alignment features may be provided to provide any number of discrete orientations between shaft 12 and club head 16. Still further, a single hosel alignment feature may be provided when a single discrete orientation between the shaft and club head is desired.

Sleeve 14 includes a distal body 38, a proximal ferrule 40 and at least one sleeve alignment feature. The present embodiment includes a pair of sleeve alignment features (e.g., tangs 42). Body 38 is generally cylindrical and includes a proximal end that is coupled to a distal end of ferrule 40. The length of shaft sleeve 14 and the diameter of shaft 12 may be selected so that adequate surface area is provided for attachment to shaft 12. Shaft sleeve 14 and shaft 12 are configured to provide approximately 0.5-2.0 $in^2$ of bonding surface area. In an embodiment, shaft sleeve 14 and shaft are selected to provide approximately 1.2 $in^2$ of bonding surface area. In particular, in that embodiment, shaft sleeve 14 has a bonding length of approximately 1.1 inches to provide adequate bonding surface area on a shaft having a 0.335 inch diameter. In the present embodiment, body 38 and ferrule 40 are coupled so that they form a single integrated component, but it should be appreciated that body 38 and ferrule 40 may be separate components.

Tangs 42 extend laterally outward beyond an outer surface of body 38 adjacent the interface between body 38 and ferrule 40. The shape of tangs 42 is selected to complement the shape of notches 32 so that relative rotation about the longitudinal axis of hosel 20 in either direction between sleeve 14 and hosel 20 is prevented when tangs 42 engage notches 32. For example, tangs 42 have a generally trapezoidal cross-sectional shape and that trapezoidal shape is selected to complement and engage the trapezoidal shape of notches 32. Tangs 42 are configured so that they are tapered with the narrowest portion oriented toward the distal end of sleeve 14 and notches 32 are similarly tapered with the narrowest portion oriented toward sole 26 of club head 16. Preferably, the tangs and notches are tapered by an angle of about 0° to about 20° relative to an axis that is parallel to the longitudinal axis of body 38. Additionally, the outer surfaces of tangs 42 are curved with a diameter that is substantially identical to the outer diameter of proximal end 28 of hosel 20 so that the outer surface of tangs 42 are substantially flush with the outer surface of hosel 20 in an assembled golf club. However, it should be appreciated that the outer surface of the tangs and the proximal end of the hosel need not be flush if desired.

The complementary shapes of notches 32 and tangs 42 assure that there is a secure fit between sleeve 14 and hosel 20 when interchangeable shaft system 10 is assembled. In particular, as sleeve 14 is inserted into sleeve bore 30 of hosel 20, the tapered side edges of tangs 42 forcibly abut the tapered side walls of notches 32 to provide a secure fit that assures consistent and repeatable positioning of sleeve 14 relative to hosel 20. The tapered surfaces also prevent rotational play between sleeve 14 and hosel 20 resulting from manufacturing tolerances or wear. Alternatively, the hosel and sleeve alignment features may have curved edges and side walls that engage during assembly to provide a similarly secure fit.

In the present embodiment, the outer diameter of body 38 is smaller than the outer diameter of the distal end of ferrule 40 so that a shoulder 46 is created at the interface between body 38 and ferrule 40. During assembly, body portion 38 of sleeve is inserted into sleeve bore 30 until shoulder 46 is disposed adjacent the top edge of hosel 20. In the present embodiment, the size, taper and/or curvature of the hosel and sleeve alignment features (e.g., tangs 42 and notches 32) are preferably selected so that there is a small amount of clearance between shoulder 46 and hosel 20 when the golf club is assembled. Additionally, with respect to the present embodiment, the size and taper of tangs 42 and notches 32 are selected so that there is a small amount of clearance between the distal end surfaces of tangs 42 and the distal end surfaces of notches 32. That clearance allows the relative position between sleeve 14 and hosel 20 to be easily controlled by manipulating the dimensions of the respective alignment features. Preferably, the amount of clearance between shoulder 46 and hosel 20 is visually imperceptible, or at least not easily noticeable, in the assembled golf club. For example, the amount of clearance may range from 0.005-0.030 inches. In embodiments utilizing a wedge member, described below, the size, taper, and/or curvature of the alignment features are preferably selected so that the end surfaces of the wedge member abut the complementary end surfaces of the shaft sleeve and hosel so that the relative angles between the parts may be more easily controlled.

Sleeve 14 and hosel 20 may be constructed from any metallic or non-metallic material, such as, for example, titanium, steel, aluminum, nylon, fiber reinforced polymer or polycarbonate. Furthermore, sleeve 14 and hosel 20 may be constructed from the same or different materials and as discussed further below each of sleeve 14 and hosel 20 may alternatively have multi-material construction. Additionally, sleeve 14 and/or hosel 20 may be constructed from a material that is a combination of both metallic and non-metallic material, such as a polymer infused or plated with metallic material. In an embodiment, hosel 20 is constructed of titanium and sleeve 14 is constructed from aluminum. Preferably, hosel 20 is formed as an integral part of club head 16.

A coating or surface treatment may also be provided on sleeve 14 and/or hosel 20 to prevent corrosion and/or to provide a desired aesthetic appearance and/or to provide additional structural properties. For example, in embodiments utilizing sleeve 14 constructed from a first metallic material, such as aluminum, and hosel 20 constructed from a second metallic material, such as titanium, sleeve 14 may be anodized to prevent galvanic corrosion. As a further example, a non-metallic sleeve 14 may be coated with nickel to provide the appearance of metallic construction and/or to provide additional strength. The coating may be selected to provide any desired characteristic, for example, to improve strength the coating may be a metallic coating, such as a nickel alloy, having a nanocrystalline grain structure.

Sleeve 14 is securely fastened to club head 16 by fastener 18 to prevent disengagement of sleeve 14 from sleeve bore 30. Fastener 18 is primarily employed to prevent relative motion between sleeve 14 and club head 16 in a direction parallel to the longitudinal axis of hosel 20 by introducing an axial compressive force. Fastener 18 may be any type of fastener that restricts relative motion between sleeve 14 and hosel 20. For example, and as shown in the present embodiment, fastener 18 is an elongate mechanical fastener, such as a machine screw that engages a threaded hole in sleeve 14. Fastener 18 and sleeve 14 are dimensioned to provide sufficient thread length to withstand the axial forces placed upon interchangeable shaft system 10. In one exemplary embodiment, fastener 18 and sleeve 14 are dimensioned to provide ¼ inch of threaded engagement. Additionally, thread inserts may be provided if desired to increase the strength of the threads. For example, a thread insert such as Heli-coil thread inserts (a registered trademark of Emhart, Inc. of Newark, Del.) may be installed into sleeve 14.

Figure 3:
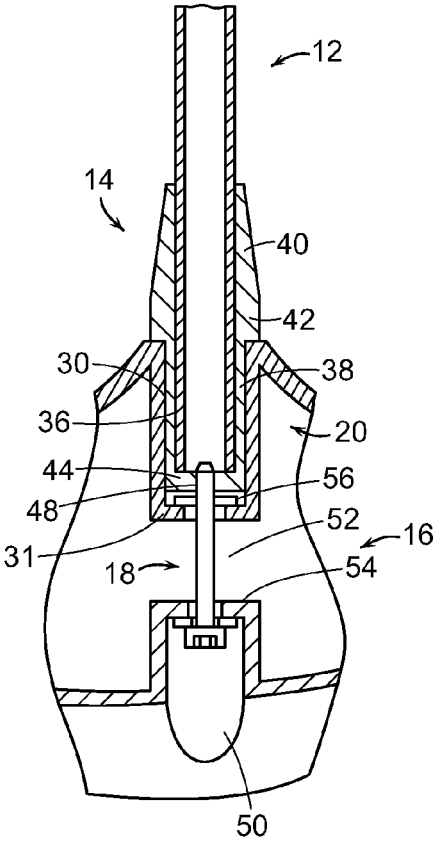
FIG. 3 is a cross-sectional view taken along line 3-3, shown in FIG. 1, of the golf club.

As shown in FIG. 3, hosel 20 extends only partially through club head 16. A separate fastener bore 50 is provided that extends into club head 16 proximally from sole 26 and is generally coaxially aligned with hosel 20. The proximal end of fastener bore 50 terminates at a proximal flange 54. Flange 54 is generally annular and provides a bearing surface for a head portion of fastener 18. A shank of fastener 18 extends through flange 54, across a gap 52 between fastener bore 50 and hosel 20, through flange 31 and engages flange 44 of sleeve 14.

During assembly, as fastener 18 is tightened, sleeve 14 is drawn into hosel 20. Simultaneously, tangs 42 of sleeve 14 are drawn into notches 32 of hosel 20 and the tapered side edges of tangs 42 forcibly abut the tapered side walls of notches 32. The tapered interface between tangs 42 and notches 32 assures that as fastener 18 is tightened in sleeve 14, the fit between sleeve 14 and hosel 20 becomes progressively more secure and sleeve 14 travels to a predetermined and repeatable position within hosel 20.

The depth of hosel 20 and sleeve bore 30 in club head 16 may be selected so that a desired length of shaft 12 and sleeve 14 are received therein. In the present embodiment, hosel 20 extends only partially into club head 16. It should, however, be appreciated that the hosel may extend through the entire club head so that it intersects the sole, as shown in the golf club of FIG. 22. In such embodiments, a flange providing a bearing surface for the head of the fastener may be located at any intermediate location within the hosel and a separate fastener bore need not be provided.

As previously described, the hosel alignment features are located adjacent proximal end 28 of hosel 20 and extend through at least a portion of the side wall of hosel 20. Locating the hosel alignment features adjacent proximal end 28 of hosel 20 greatly simplifies manufacture of the hosel alignment features and club head 16 because the area is easily accessible. In particular, alignment features having precise tolerances may be incorporated into hosel 20 by simple machining processes and using common tools. For example, a generally trapezoidal hosel alignment feature extending entirely through the sidewall of hosel 20, such as notch 32, may be machined using a tapered end mill that is passed diametrically across proximal end 28 of a cast club head 16. As a result of that location, hosel alignment features having tightly controlled dimensions may be easily constructed with any desired shape by using simple tooling and processes.

The alignment features may be positioned at any location around the circumference of sleeve 14 and hosel 20. Preferably, a pair of alignment features are disposed approximately 180° apart about the circumference of body 38 and hosel 20 (i.e., the alignment features are diametrically opposed) with one of the features being located adjacent face 24 of club head 16. That orientation results in the alignment features being obscured from sight when a user places the club in the address position and views the club along a line of sight that is generally parallel to the longitudinal axis of shaft 12. That orientation also allows the alignment features to be easily viewed by a user during adjustment by viewing club head 16 along a line of sight that is generally normal to face 24.

As an additional feature, a locking mechanism may be provided to prevent fastener 18 from disengaging from sleeve 14. Any locking mechanism may be employed. For example, lock washers may be provided between the head of fastener 18 and the adjacent bearing surface. As a further alternative, a locking thread design, such as a Spiralock locking internal thread form (a registered trademark of Detroit Tool Industries Corp. of Madison Heights, Mich.) may be incorporated into threaded bore 48 of flange 44. As a still further alternative, a thread locking material, such as Loctite thread locking adhesive (a registered trademark of the Henkel Corp. of Gulph Mills, Pa.) may be applied to fastener 18 or threaded bore 48. Still further, fastener 18 may be provided with a locking feature such as a patch lock. Additionally, a bonding material, such as epoxy may be applied to the head of fastener 18 at an interface with club head 16 after assembly.

As a still further feature, a retainer 56 may be employed so that fastener 18 is retained within club head 16 when it is not engaged with sleeve 14. During replacement of shaft 12 it is desired that fastener 18 is retained within club head 16 so that it is not misplaced. Retainer 56 is coupled to the shank of fastener 18 and located so that a flange is interposed between retainer 56 and the head of fastener 18. Retainer 56 is sized so that it is not able to pass through the through hole of the respective flange. Retainer 56 may be a clip that is frictionally coupled to the shank of fastener 18 adjacent flange 31 of hosel 20 located so that flange 31 is interposed between retainer 56 and the head of fastener 18.

Figure 7:
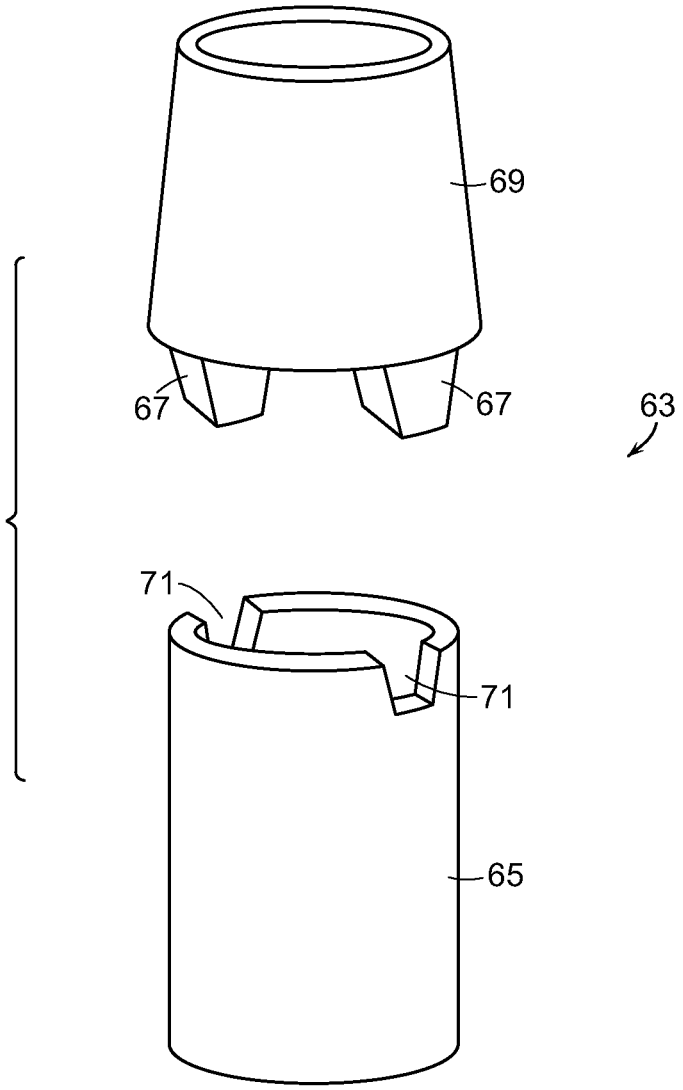
FIG. 7 is a perspective view of another embodiment of the shaft sleeve of the interchangeable shaft system.
Figure 8:
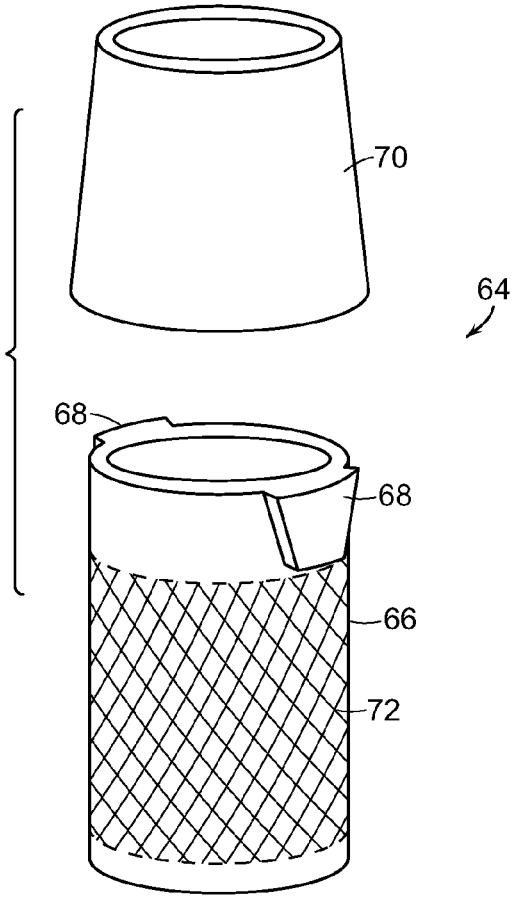
FIG. 8 is a perspective view of another embodiment of the shaft sleeve of the interchangeable shaft system.

Referring to FIGS. 7 and 8 embodiments of a multi-piece shaft sleeve will be described that may be substituted for shaft sleeve 14 in the previously described interchangeable shaft system. The multi-piece embodiments provide a configuration that allows for the use of alternative machining processes as compared to a single piece, machined or molded shaft sleeve. Additionally, it provides additional options for including multiple materials in a single shaft sleeve which may provide weight and/or manufacturing advantages. In an embodiment, shaft sleeve 63 includes a multi-piece construction that includes a body 65, a pair of alignment features (e.g., tangs 67) and a ferrule 69. In the present embodiment, tangs 67 are integral with ferrule 69, but body 65 is a separate component.

Body 65 is generally cylindrical and includes a proximal end that is located adjacent a distal end of ferrule 69 when assembled on a shaft. The proximal end of body 65 includes notches 71 that are sized and shaped to complement the size and shape of tangs 67. In particular, notches 71 are preferably sized and shaped so that there are no gaps between the distal surface of ferrule 69 and the proximal end surface of body 65 or between the side surfaces of tangs 67 and the side surfaces of notches 71. Additionally, the thickness of tangs 67 is selected so that when shaft sleeve 63 is assembled, portions of tangs 67 extend radially outward beyond the outer surface of body 65. As a result, that portion of tangs 67 extending radially outward from body 65 is available to engage engagement features provided in the proximal end portion of the hosel of a golf club head as described above.

Referring to FIG. 8, another alternative embodiment of the shaft sleeve will be described. Shaft sleeve 64 includes a body 66, a pair of alignment features (e.g., tangs 68) and a ferrule 70. Tangs 68 are integral with body 66 and ferrule 70 is separate from tangs 68 and body 66. Body 66 is generally cylindrical and includes a proximal end that is located adjacent a distal end of ferrule 70 when assembled on a shaft. Tangs 68 extend laterally outward from body 66 adjacent the proximal end of body 66.

Body 66 and ferrule 70 may be constructed from any materials and they may be constructed from the same or different materials. For example, body 66 may be machined from a metallic material, such as aluminum, and ferrule 70 may be molded or machined from a non-metallic material, such as nylon. Different materials may be used to provide weight savings over an entirely metallic sleeve while still providing adequate structural qualities and bonding surface area. Additionally, different materials may be selected to provide desired aesthetic properties.

The body of any embodiment of the shaft sleeve may further include weight reducing features if desired. For example, and as shown in FIG. 8, shaded portion 72 may include slots, depressions, through holes or any other feature that reduces the volume of material from which body 66 is constructed. The volume of body material may be reduced over any desired portion of the shaft sleeve body as long as sufficient surface area is provided for adequately coupling the shaft with the shaft sleeve.

Figure 9:
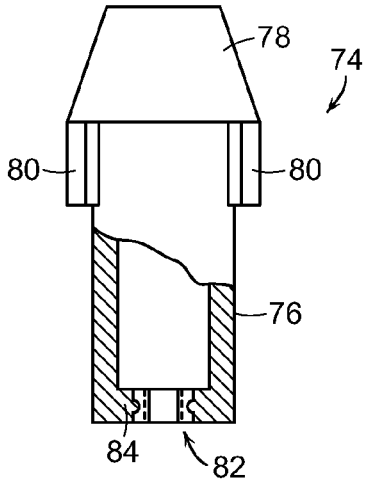
FIG. 9 is a partial cross-sectional view of another embodiment of the shaft sleeve of the interchangeable shaft system.

A further embodiment of the shaft sleeve is illustrated in FIG. 9. Similar to the previously described embodiments, shaft sleeve 74 includes a body 76, a ferrule 78 and tangs 80 extending laterally outward from body 76. Shaft sleeve 74 is illustrative of a single piece construction of the shaft sleeve that is molded from a non-metallic material, such as, for example, nylon, fiber reinforced polymer or polycarbonate. Because of that construction, shaft sleeve 74 also includes a threaded insert 82 that is molded into a distal flange 84 of sleeve 74. Threaded insert 82 may include features that allow the insert to be securely molded in place, such as knurling and/or one or more ribs or flanges.

Figure 10:
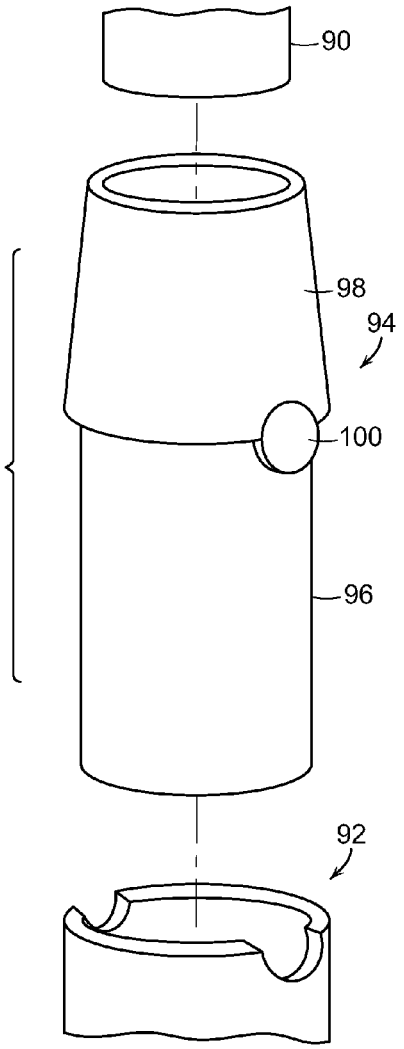
FIG. 10 is an exploded view of a golf club including another embodiment of the interchangeable shaft system of the present invention.

A still further embodiment of the shaft sleeve is shown in FIG. 10, which illustrates an exploded view of a portion of another embodiment of a golf club including an interchangeable shaft system. Similar to the previously described embodiments, the golf club includes a shaft 90 that is coupled to a hosel 92 of a club head by an interchangeable shaft system that includes a shaft sleeve 94.

In the present embodiment, sleeve 94 utilizes a multi-piece construction. Sleeve 94 includes body 96 that is integral with ferrule 98 and sleeve alignment features that are formed by a separate pin 100 that is coupled to body 96 and ferrule 98. Pin 100 extends diametrically across the interface of body 96 and ferrule 98 and is securely coupled to body 96 and ferrule 98. The length of pin 100 is selected so that the ends of pin 100 extend laterally outward beyond the outer surface of body 96. Preferably, each end of pin 100 extends laterally outward of body 96 by a distance corresponding to the thickness of the side wall of hosel 92 of the club head so that the ends of pin 100 are generally flush with the outer surface of hosel 92. Although pin 100 is illustrated as a generally cylindrical member, it should be appreciated that it may have any desired cross-sectional shape and hosel 92 may include hosel alignment features having any complementary shape. For example, pin 100 may be a key having any polygonal cross-sectional shape, such as a triangle, trapezoid, square, rectangle, diamond, etc.

The interchangeable shaft system of the present invention may be configured to provide adjustability for the angular attributes of an assembled golf club, including face angle, lie and loft. As described above, the configuration of the hosel and sleeve alignment features provide discreet orientations of the sleeve relative to the hosel. The shaft may be mounted to the sleeve so that the shaft is not coaxial with the sleeve. That misalignment allows each of the discreet orientations of the sleeve relative to the hosel to correspond to a different orientation of the shaft to the club head. For example, by mounting the shaft to the sleeve so that the longitudinal axis of the shaft is rotated relative to the shaft, the angular attributes of the assembled golf club may be adjustable by changing the orientation of the shaft sleeve relative to the hosel.

Figure 11:
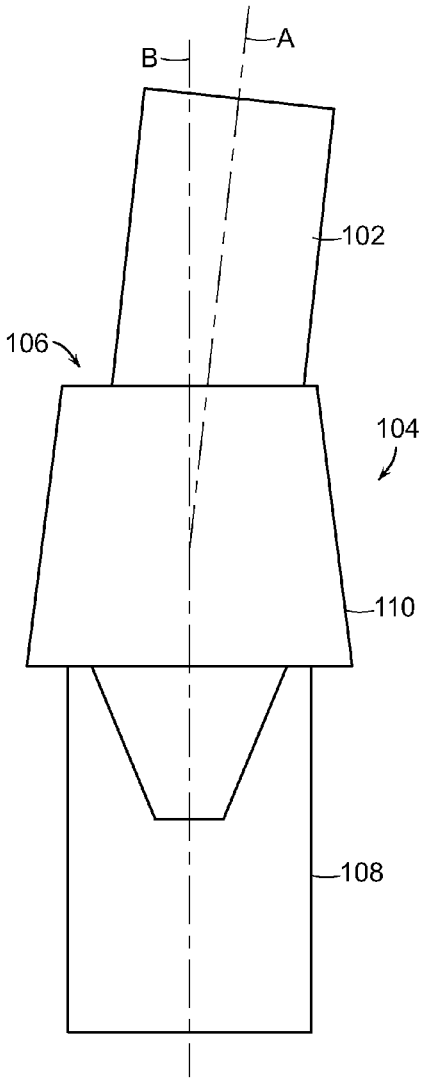
FIG. 11 is a schematic of the connection between a shaft sleeve and a shaft of the interchangeable shaft system.

As shown in FIG. 11, a shaft 102 is mounted to a sleeve 104 so that an angular attribute, or select combinations of angular attributes, may be adjusted between at least a first configuration and a second configuration. In particular, a longitudinal axis A of a shaft bore 106 of sleeve 104 may be rotated relative to a longitudinal axis B of a body 108 and a ferrule 110 of sleeve 104 (i.e., the shaft bore is not coaxial with body 108). Preferably, the shaft bore is rotated relative to the longitudinal axis of the body by about 0° to about 5°. As a result, when a shaft 102 is inserted into shaft bore 106, the longitudinal axis of shaft 102 is coaxial with longitudinal axis A of shaft bore 106. By rotating sleeve 104 approximately 180°, the orientation of shaft 102 relative to sleeve 104 changes from a positive to a negative angle relative to longitudinal axis B.

The direction of the rotational offset between axis A and axis B may positioned relative to the hosel and sleeve alignment features so that rotation of the sleeve within the hosel between the two positions alters the club face angle. In particular, the sleeve may be coupled to the hosel in a first position corresponding to a first configuration wherein the club face is opened. The sleeve may then be coupled to the hosel in a second position, e.g., the sleeve is rotated 180° from the first position, which corresponds to a second configuration wherein the club face is closed. It should be appreciated that the positions may be any combination of closed, neutral or opened club face orientations and in some embodiments both positions may be closed or opened, but by different amounts. It should be appreciated that shaft 102 and sleeve 104 may be coupled so that more than two configurations are provided. For example, the sleeve and accompanying golf club head may be configured so that there are more than two relative configurations thereby providing adjustability in multiple combinations of angular attributes.

Additionally, the depth of the hosel alignment features may be different and, as a result, a golf club including the interchangeable shaft system of the present invention may be adjustable for overall length by providing a plurality of hosel alignment features having different depths. For example, in an embodiment, a pair of hosel alignment features having different depths from the proximal end of the hosel are provided in a golf club head. A shaft sleeve is provided that includes a single sleeve alignment feature that is sized and shaped to engage either of the hosel alignment features. In a first configuration, the sleeve alignment feature is engaged with the deeper hosel alignment feature, which results in the sleeve being drawn into the hosel to a first depth and thereby providing a first overall golf club length. In a second configuration, the sleeve alignment feature is engaged with the shallower hosel alignment feature, which results in the sleeve being drawn into the hosel to a second depth that is less than the first depth and thereby providing a second overall golf club length that is less than the first.

Figure 12:
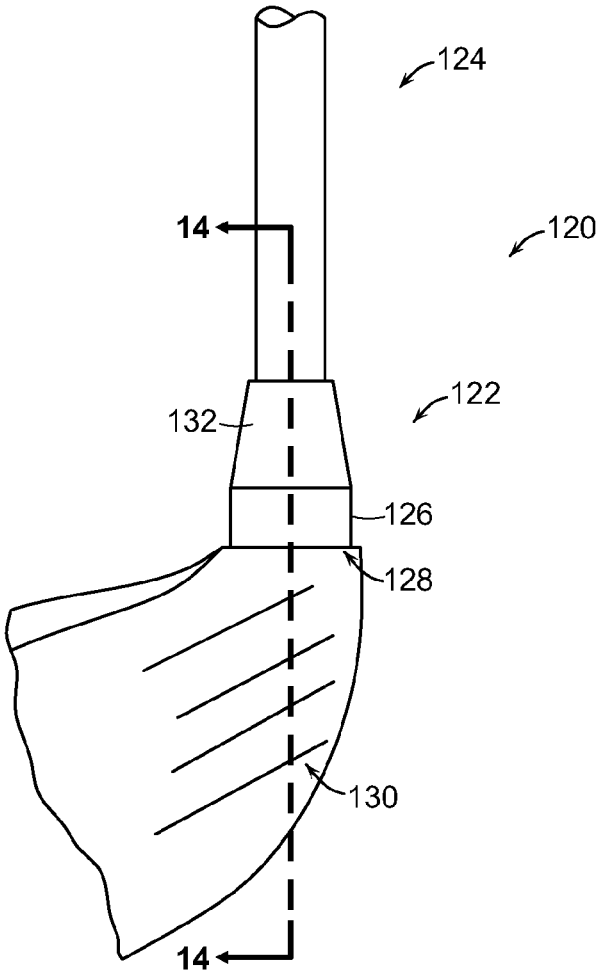
FIG. 12 is side view of a portion of a golf club including another embodiment of the interchangeable shaft system of the present invention.
Figure 13:
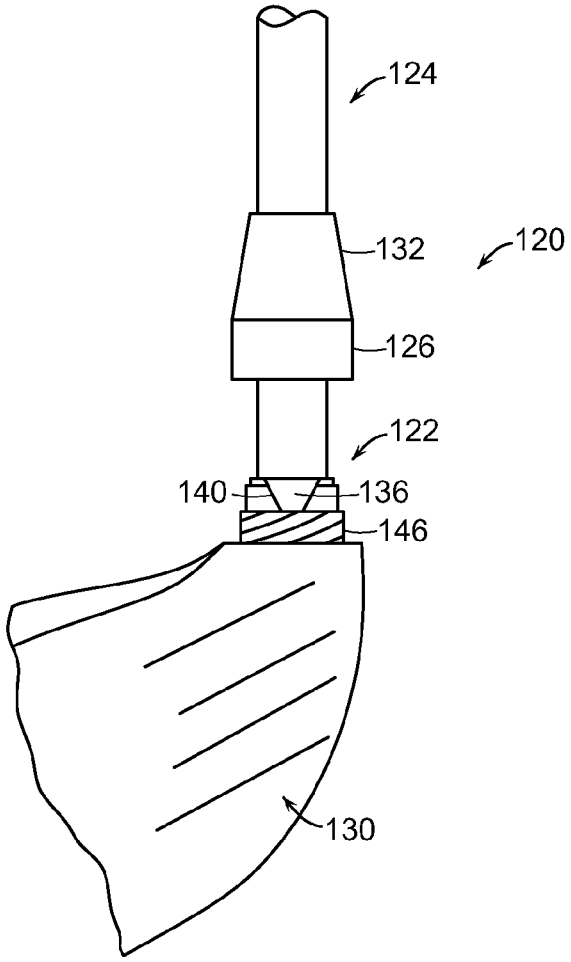
FIG. 13 is a partial exploded view of the golf club of FIG. 12.
Figure 14:
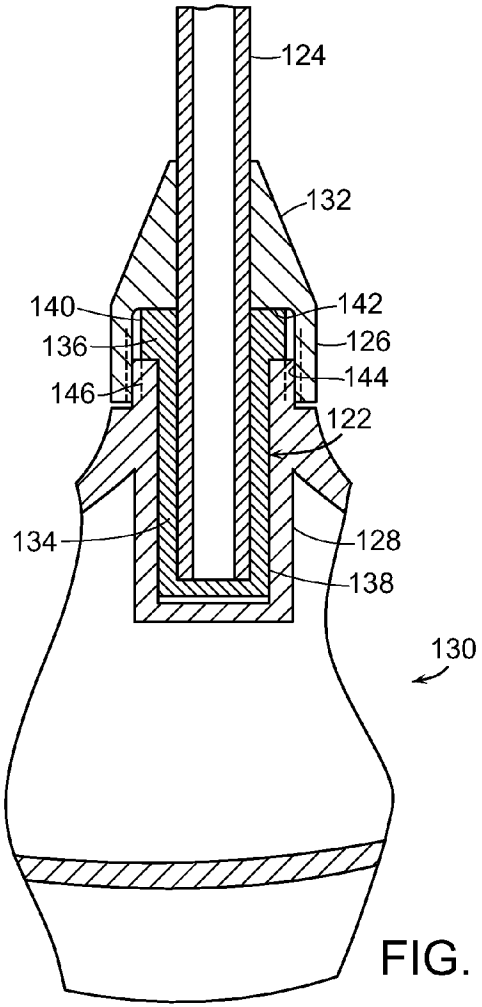
FIG. 14 is a cross-sectional view taken along line 14-14, shown in FIG. 12, of the golf club.

Referring to FIGS. 12-14, another embodiment of the interchangeable shaft system of the present invention will be described. Interchangeable shaft system 120 is similar to the previously described embodiments in that it generally includes a shaft sleeve 122 that is coupled to a shaft 124 and a fastener 126 that retains sleeve 122 within a hosel 128 of a club head 130. In the present embodiment, however, fastener 126 is integral with a ferrule 132.

Sleeve 122 includes a body 134 and alignment features (e.g., tangs 136). Sleeve 122 includes a separate ferrule 132. In the assembled golf club, body 134 of sleeve 122 is at least partially received within a sleeve bore 138 of hosel 128. Body 134 is oriented so that tangs 136 engage complementary alignment features of hosel 128 (e.g., notches 140).

Fastener 126 is integrated into and forms a portion of ferrule 132. In particular, fastener 126 is a distal portion of ferrule 132 that is configured to mechanically engage a portion of hosel 128. For example, fastener 126 is a portion of ferrule 132 that includes a threaded internal 144 surface and is configured to threadably engage a threaded outer surface 146 of hosel 128.

Ferrule 132 also includes a bearing surface 142. Bearing surface 142 forcibly abuts a proximal end surface of sleeve 122 when interchangeable shaft system 120 is assembled. During assembly, shaft 124 is inserted through ferrule 132 so that ferrule 132 is able to slide on and rotate relative to shaft 124. Next, sleeve 122 is coupled to the distal end of shaft 124. The dimensions of sleeve 122 are selected so that ferrule 132 is prevented from sliding past sleeve 122 toward the distal end of shaft 124. Sleeve 122 is then inserted into sleeve bore 138 so that tangs 136 engage notches 140 with sleeve 122 in a desired rotational orientation. Finally, ferrule 132 is slid along shaft 124 until bearing surface 142 abuts sleeve 122 and fastener 126 is threaded on hosel 128.

Indicia may be provided to clearly indicate the configuration of the shaft relative to the club head in the assembled golf club. For example, and as described above, the shaft may be coupled to the shaft sleeve so that the club can be assembled in a first or second configuration. Indicia may be placed on the shaft sleeve and/or the hosel to indicate the assembled configuration. The indicia may be positioned so that they are visible only during assembly or during and after assembly, as desired.

Referring to FIGS. 15-19, any form of indicia may be provided. The indicia may be engraved, raised, printed and/or painted and they may be one or more letters, numbers, symbols, dots and/or other markings that differentiate the available configurations of the golf club. The indicia may be included on any portion of the club head, shaft sleeve, or shaft of the assembled golf club. Preferably, indicia are provided on or adjacent the sleeve and/or hosel alignment features.

Figure 16:
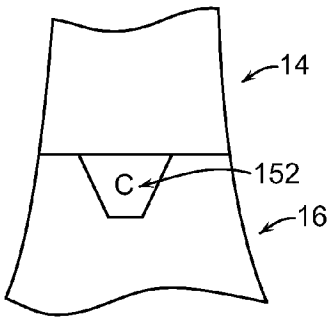
FIGS. 15-19 are side views of various indicia that may be incorporated into a golf club including the interchangeable shaft system of the present invention.
Figure 15:
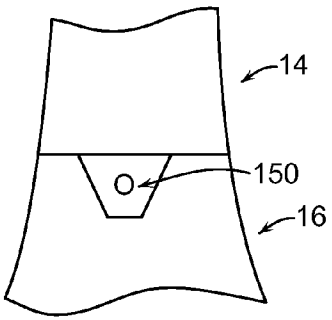

As shown in FIGS. 1, 15 and 16, the indicia may include letters corresponding to the configuration of the golf club. In an embodiment, indicium 150 is an "O" that is located on a sleeve alignment feature and corresponds to an opened face angle configuration of the golf club. Additionally, indicium 152, in the form of a letter "C," is provided on another sleeve alignment feature that corresponds to a closed face angle club configuration.

As shown in FIG. 1, the hosel and shaft sleeve alignment features (e.g., notches 32 and tangs 42) and/or indicia are positioned to reduce the visibility of those features during use. In particular, in the assembled golf club, tangs 42 are located so that they are diametrically opposed from each other about the circumference of hosel 20 on an axis that is generally normal to a plane defined by face 24 of club head 16. As a result, tangs 42 are visible along a line of sight generally normal to face 24 of club head 16. However, when a user holds the club in the address position, the tangs 42 are obscured from view, i.e., the alignment features are not visible along an axis generally parallel to the longitudinal axis of the shaft, and the golf club has an appearance of a golf club lacking the interchangeable shaft system when the golf club head is at address.

Figure 18:
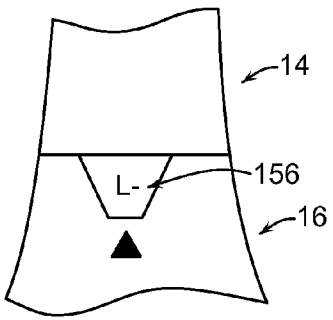
Figure 17:
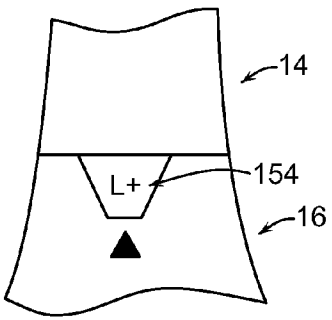

Additional examples of indicia are illustrated in FIGS. 17 and 18. In FIG. 17 indicia 154 and 156 include both letters and symbols (e.g., "L+" and "L−"). Combinations of letters, symbols and/or numbers may be used to clearly indicate the configuration of the assembled golf club. In the present example, indicia 154 and 156 are particularly well-suited to indicate increased and reduced lie or loft angle of the club head, respectively. Additionally, an indicium may be provided to indicate to the user which of the indicia included on sleeve 14 corresponds to the assembled configuration of the golf club. As a further example, indicium 158, shown in FIG. 19, may include numbers such as "0" and "1" or "1" and "2" to indicate the configuration of the components.

The interchangeable shaft system of the present invention provides advantages over conventional methods of club fitting. In a conventional fitting session a user is required to make test swings with a plurality of non-adjustable samples of a single golf club. For example, a conventional fitting cart, or bag, generally includes a plurality of sample 6-Irons having multiple configurations. The user is required to try many of those sample clubs to try to determine which sample includes the most appropriate configuration. However, because each sample club is not adjustable, differences between the individual components of the plurality of sample clubs introduce additional variables into the fitting process and the fitting cart, or bag, is required to include many separate and complete sample clubs.

A method of fitting golf clubs to a user utilizing the interchangeable shaft system of the present invention removes many of those additional variables and reduces the number of required complete sample clubs by minimizing the number of components required for the fitting process. The interchangeable shaft system allows a single club head to be used throughout the fitting process with different shafts and/or by altering the orientation of a single shaft relative to the club head. The system also allows different club heads to be utilized with a single shaft if desired.

The method includes providing a golf club including the interchangeable shaft system of the present invention in a first configuration. Next, the user swings the golf club while it is in the first configuration. The user's swing and the ball flight characteristics are analyzed and the interchangeable shaft system of the golf club is disassembled and re-assembled into a second configuration. The user then swings the golf club while it is in the second configuration and the user's swing and the ball flight characteristics are analyzed. These steps may be repeated with any number of golf club configurations. Finally, the proper club configuration for the user is determined based on the analyses of the user's swings.

During the re-assembly of the interchangeable shaft system into a second configuration, many different operations may be preformed. For example, the combined shaft and sleeve that was included in the golf club in the first configuration may be re-oriented relative to the club head to provide a change in one, or combinations, of the angular attributes of the golf club. Alternatively, the shaft and sleeve combination may be substituted and a different shaft and sleeve attached to the club head. A substitution of the shaft and sleeve combination may be desired to change angular attributes and/or any other physical attribute of the golf club, such as shaft flexibility, shaft length, grip style and feel, etc.

Figure 21:
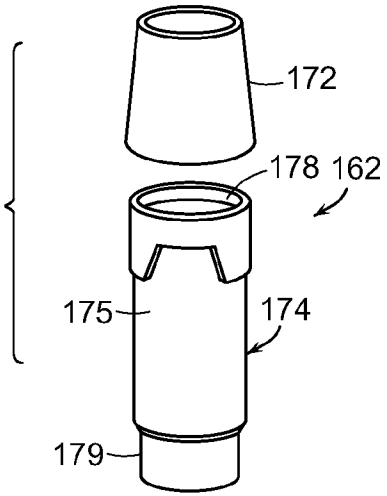
FIG. 21 is a perspective view of another embodiment of the shaft sleeve of the interchangeable shaft system.
Figure 20:
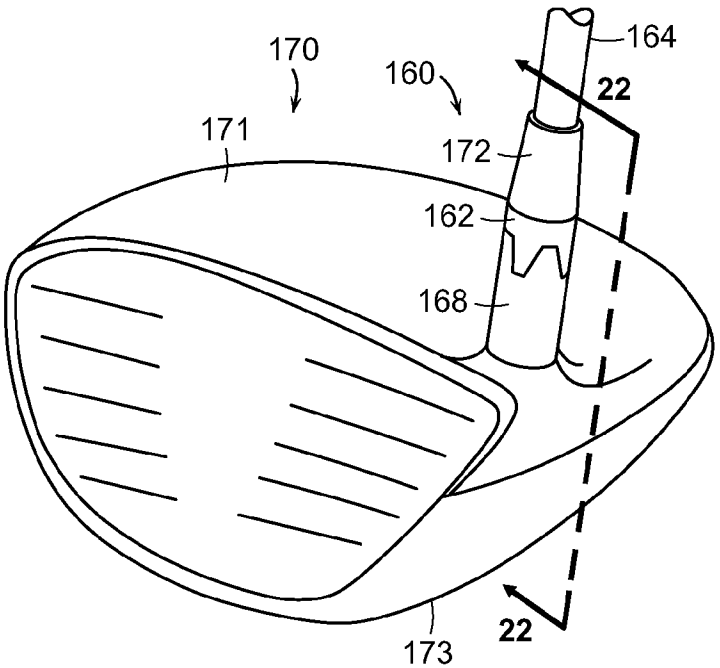
FIG. 20 is a perspective view of a portion of an exemplary golf club including an embodiment of the interchangeable shaft system of the present invention.
Figure 19:
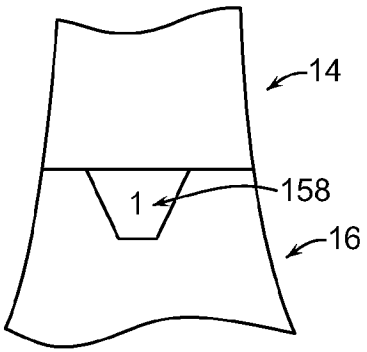
Figure 22:
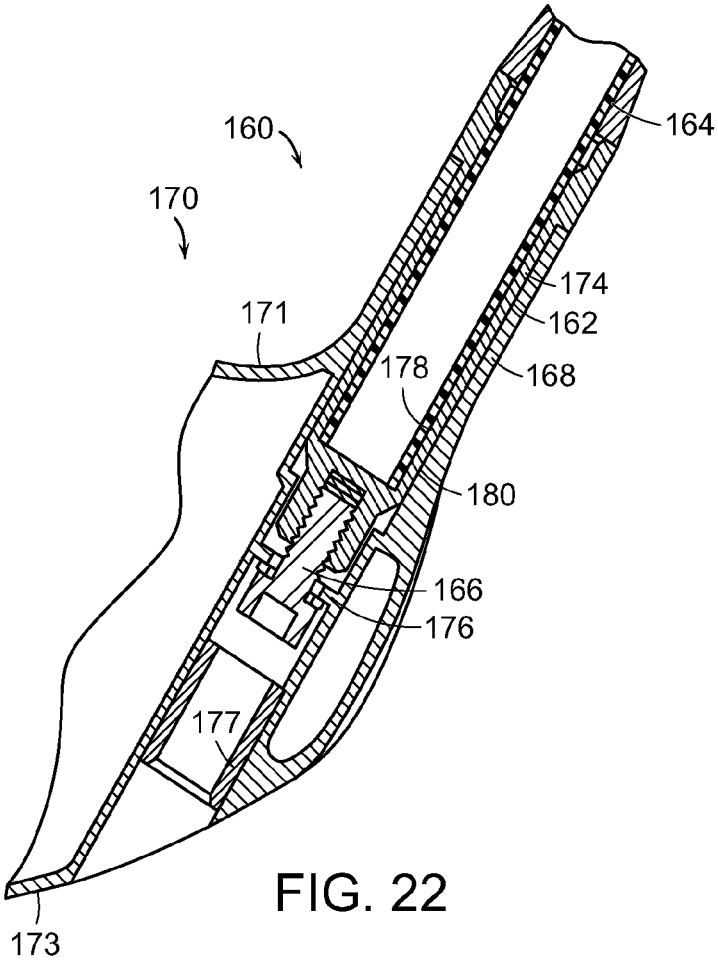
FIG. 22 is a cross-sectional view, taken along line 22-22 of FIG. 20, of a golf club including the interchangeable shaft system of the present invention.

Another embodiment of a golf club including an interchangeable shaft system of the present invention is illustrated in FIGS. 20-22. Interchangeable shaft system 160 generally includes a shaft sleeve 162 that is coupled to a shaft 164, and a fastener 166 that retains sleeve 162 within a hosel 168 of a club head 170. In the present embodiment, however, hosel 168 extends through the entire club head 170 so that it intersects both a crown 171 and a sole 173 of club head 170.

Sleeve 162 includes a body 174 and alignment features (e.g., tangs). Body 174 includes a shaft portion 175 and a fastener portion 179. Shaft portion 175 is generally tubular and defines a shaft bore 178. Fastener portion 179 is generally cylindrical and has an outer diameter that is less than or equal to the outer dimension of shaft portion 175. Fastener portion 179 includes a threaded bore that engages fastener 166.

In the assembled golf club, body 174 of sleeve 162 is at least partially received within sleeve bore 180 of hosel 168. Body 174 is oriented so that the alignment features of sleeve 162 engage complementary alignment features of hosel 168 (e.g., notches). Additionally, a ferrule 172 may be included that abuts the proximal end of shaft sleeve 162 to provide a tapered transition between shaft sleeve 162 and shaft 164.

Fastener 166 is an elongate mechanical fastener, such as a machine screw that engages a threaded hole in sleeve 162. Fastener 166 and sleeve 162 are dimensioned to provide sufficient thread engagement length to withstand the axial forces placed upon interchangeable shaft system 160.

A flange 176 is included within hosel 168 at an intermediate position along the length of hosel 168. Flange 176 is generally annular so that it includes a through hole that is sized so that the threaded shank of fastener 166 extends through the hole and so that the head of fastener 166 is prevented from passing through the hole. Flange 176 provides a bearing surface for the head of fastener 166 when it is engaged with sleeve 162 so that fastener 166 may be placed in tension when tightened in the threaded bore of sleeve 162.

Interchangeable shaft system 160 also includes a retainer 177 to retain fastener 166 within hosel 168 of club head 170 when it is not engaged with sleeve 162 such as during replacement or orientation of the shaft. Retainer 177 is a tubular body that is slidably received within hosel 168 on the side of hosel 168 closest to sole 173 so that the head of fastener 166 is disposed between retainer 177 and flange 176. The inner diameter of retainer 177 is selected so that it is smaller than the outer diameter of the head of fastener 166 but larger than the outer dimension of a tool that is utilized to rotate fastener 166. Alternatively, the retainer may be a solid plug that is preferably removable so that the retainer may be removed to access fastener 166.

Additionally, the swing weight of a golf club incorporating the interchangeable shaft system of the present invention may be altered using a sleeve having a desired weight. During assembly of a golf club, the club head is often weighted to compensate for manufacturing tolerances and/or to create a desired swing weight. In the present embodiment, shaft sleeve configurations having various weights may be provided so that they may be easily matched with the weights of the other components to provide the desired swing weight.

Figure 23:
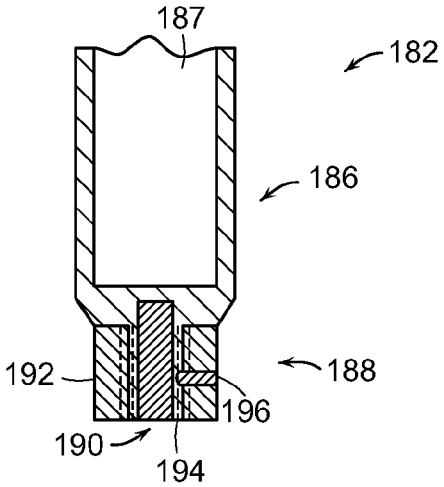
FIG. 23 is a cross-sectional view, taken on a plane that extends through a longitudinal axis, of a portion of an embodiment of a shaft sleeve.

Referring to FIG. 23, a shaft sleeve 182 includes a body that has a shaft portion 186 and a fastener portion 188. Shaft portion 186 is generally tubular and defines a shaft bore 187 that is sized to receive an end of a golf club shaft. Fastener portion 188 is generally cylindrical and has an outer diameter that is preferably less than or equal to the outer dimension of shaft portion 186. Fastener portion 188 includes a threaded bore 190 extending into a post 194 that engages a fastener in an assembled interchangeable shaft system. In the present embodiment, fastener portion 188 also includes a weight 192 that is coupled to post 194. Weight 192 is generally configured to be removably coupled to post 194 so that weights 192 having different masses may be selectively attached to fastener portion 188. For example, weight 192 may be attached with a threaded interface between weight 192 and post 194 or weight 192 may be slidably engaged with post 194 and staked in place by a mechanical fastener 196 extending radially through weight 192, such as a set screw or pin. As a further alternative, weight 192 may be semi-permanently coupled to the body, such as by applying an adhesive, or permanently attached, such as by welding, press-fitting or shrink-fitting.

Figure 24:
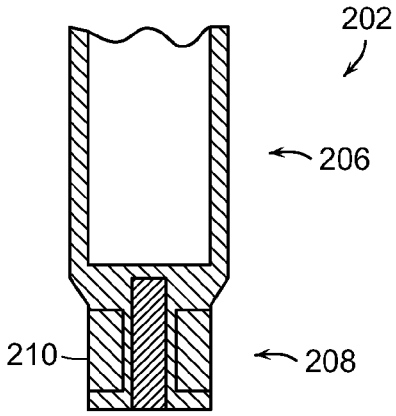
FIG. 24 is a cross-sectional view, taken on a plane that extends through a longitudinal axis, of a portion of another embodiment of a shaft sleeve

Referring to FIG. 24, another embodiment of a shaft sleeve 202 will be described. Shaft sleeve 202 includes a body that has a shaft portion 206 and a fastener portion 208. Similar to the previously described embodiment, shaft portion 206 is configured to receive an end of a golf club shaft and fastener portion 208 is configured to engage a fastener in an assembled interchangeable shaft system. Fastener portion 208 includes a weight 210 that forms a part of fastener portion 208. In particular, weight 210 is a sleeve that is co-molded with fastener portion 208 of shaft sleeve 202 so that weight 210 is permanently coupled to shaft sleeve 202.

The materials and sizes of the weights of the embodiments described above are selected to provide a desired final weight of the shaft sleeve. Shaft sleeves having various weights may be constructed so that the shaft sleeve can be matched to the weight of a club head during assembly to provide a desired swing weight. The weights are generally constructed from a material that has a different density than the remainder of the shaft sleeve. For example, to add mass to an aluminum shaft sleeve a weight constructed of titanium, steel and/or tungsten may be employed. Additionally, a powder filled polymer, such as a tungsten filled thermoplastic may be employed. The mass of an aluminum shaft sleeve may be reduced by employing a weight constructed of a material having a lower density than aluminum such as polycarbonate or fiber reinforced plastic.

Figure 25:
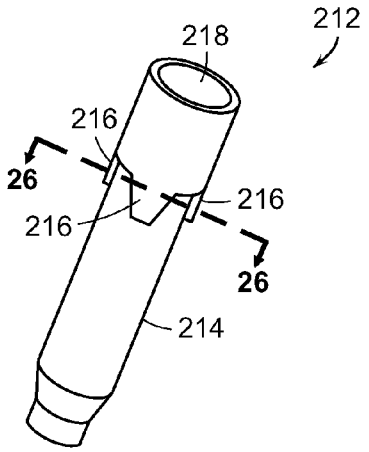
FIG. 25 is a perspective view of a shaft sleeve of the interchangeable shaft system.

Referring to FIG. 25, another embodiment of a shaft sleeve 212 will be described. Sleeve 212 includes a body 214 and alignment features, in the form of tangs 216, located near a proximal portion of body 214. The present embodiment includes three tangs 216 spaced equidistant circumferentially about a proximal portion of body 214, i.e., spaced by about 120° about the circumference of body 214. Body 214 is generally cylindrical and includes a proximal end that is disposed adjacent to a distal end of a ferrule in an assembled golf club. The length of shaft sleeve 212 and the diameter of a shaft bore 218 of sleeve 212 are selected to provide adequate bonding surface area with a golf club shaft.

Tangs 216 extend laterally outward beyond an outer surface of body 214. The shape of tangs 216 is selected to complement the shape of notches included in a hosel of a complementary golf club head so that relative rotation about the longitudinal axis of the hosel between sleeve 212 and the hosel is prevented when tangs 216 engage the notches. Similar to previously described embodiments, tangs 216 have a generally trapezoidal cross-sectional shape and that trapezoidal shape is selected to complement and engage trapezoidally shaped notches.

Relative rotation between the shaft sleeve and the hosel is prevented by engagement between alignment features on the shaft sleeve and on the hosel. In particular, abutment between side surfaces 217 of tangs 216 and corresponding side surfaces of the complementary hosel alignment features. Side surfaces 217 may be oriented to alter the magnitude of the normal and tangential forces that are placed on the abutting side surfaces.

Figure 26:
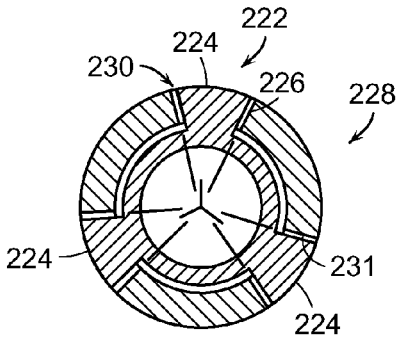
FIG. 26 is a cross-sectional view, taken along line 26-26, of a shaft sleeve that is engaged with a complementary hosel.

Referring to FIG. 26, a shaft sleeve 222 includes tangs 224 that include side surfaces 226 and shaft sleeve 222 is shown engaged in a hosel 228 that includes notches 230 that complement tangs 224. Side surfaces 226 of tangs 224 are generally planar and are oriented on planes that extend radially through shaft sleeve 222. Similarly, side surfaces 231 of notches 230 are generally planar and are oriented on planes that extend radially through shaft sleeve 222. As a result of that orientation, when sleeve 222 is rotated about its longitudinal axis relative to hosel 228 the forces produced between side surfaces 226 of tangs 224 and side surfaces 231 of notches 230 are oriented predominantly normal to the side surfaces.

Figure 27:
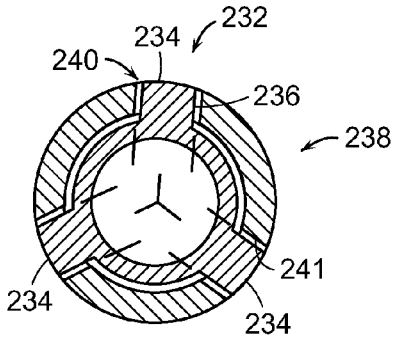
FIG. 27 is an alternative cross-sectional view, taken along line 26-26, of a shaft sleeve that is engaged with a complementary hosel.

In another embodiment, shown in FIG. 27, a shaft sleeve 232 includes tangs 234 that include side surfaces 236 and is shown engaged in a hosel 238 that includes notches 240 that complement tangs 234. Side surfaces 236 of tangs 234 are generally planar and are oriented on planes that are parallel and spaced from planes that extend radially through shaft sleeve 232. Similarly, side surfaces 241 of notches 240 are generally planar and are oriented on planes that are parallel and spaced from planes that extend radially through shaft sleeve 232. As a result of that orientation, when sleeve 232 is rotated about its longitudinal axis relative to hosel 238 the force produced between side surfaces 236 of tangs 234 and side surfaces 241 of notches 240 include both normal and tangential oriented components relative to the side surfaces. It should be appreciated that the side surfaces of the alignment features need not be planar, such as by including faceted side surfaces so that they tend to self-center when placed under rotational load.

Figure 28:
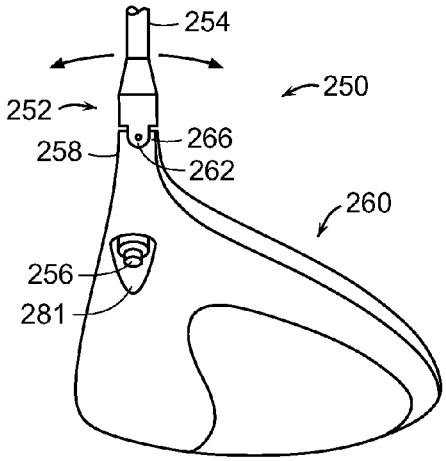
FIG. 28 is a side view of a portion of an exemplary golf club including an embodiment of the interchangeable shaft system of the present invention.

Referring to FIGS. 28 and 29, another embodiment of an interchangeable shaft system 250 will be described. Interchangeable shaft system 250 is configured to provide additional adjustability to the system by permitting a shaft sleeve 252 to tilt within a hosel 258 of a golf club head 260 in addition to being permitted to rotate 180° relative to hosel 258. Interchangeable shaft system 250 generally includes shaft sleeve 252 that is coupled to a shaft 254, and a fastener 256 that retains sleeve 252 within hosel 258.

Sleeve 252 includes a body and alignment features (e.g., tangs 262). The body includes a shaft portion 267 and a fastener portion 268. Shaft portion 267 is generally tubular and defines a shaft bore. Fastener portion 268 is also generally cylindrical and includes a threaded bore that engages fastener 256.

Shaft sleeve 252 includes a pair of tangs 262 that include generally cylindrical side surfaces 266. The cylindrical side surfaces of the opposing tangs 262 are concentric and have the same radius of curvature. Hosel 258 includes alignment features in the form of notches 272 that also have cylindrical side surfaces 274 that are concentric and abut the cylindrical side surfaces of tangs 262 in the assembled interchangeable shaft system 250. It should be appreciated that side surfaces 274 of notches 272 may alternatively be polygonal so that the cylindrical side surfaces 266 of tangs 262 contact side surfaces 274 at a plurality of tangential contact points.

Figure 29C:
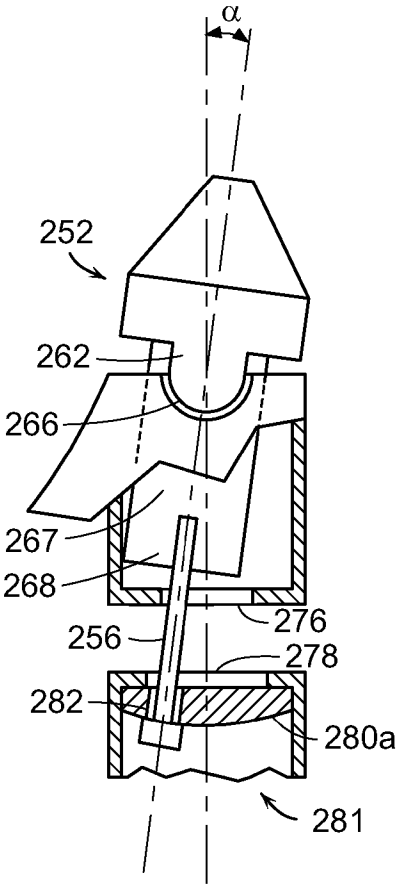
FIGS. 29A-C are partial cross-sectional views illustrating the interchangeable shaft system of FIG. 28 in various configurations.
Figure 29B:
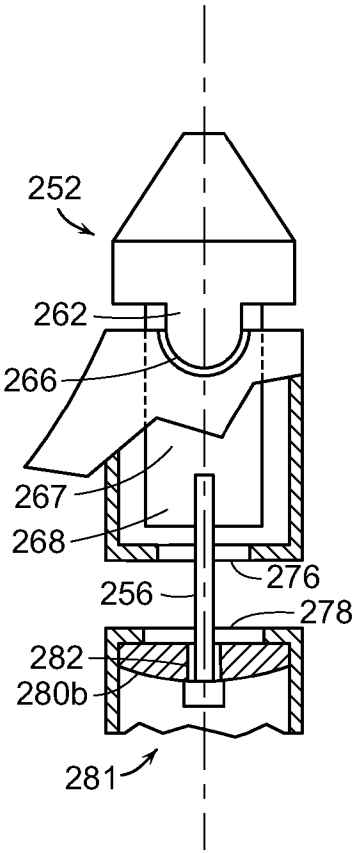
Figure 29A:
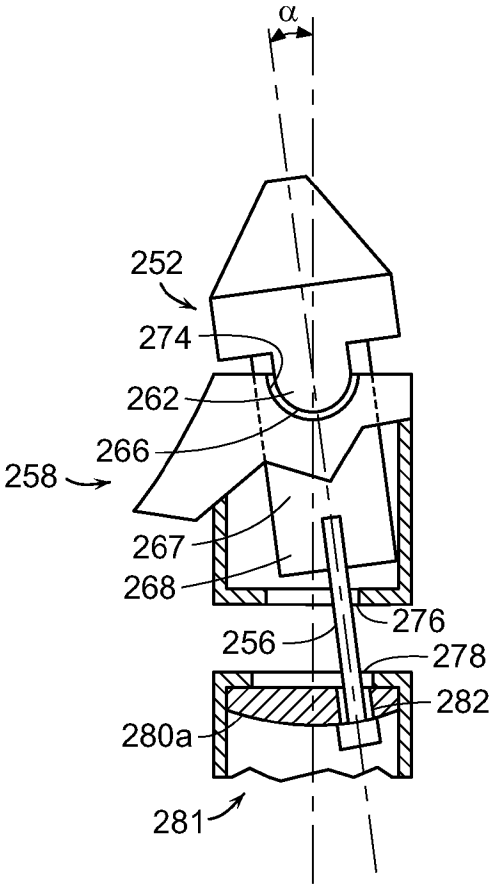

As illustrated in FIGS. 29A-29C, the cylindrical side surfaces of tangs 262 and notches 272 slide relative to each other so that shaft sleeve 252 rotates about an axis extending through the center of curvature of those surfaces and tilts relative to hosel 258. FIG. 29A illustrates shaft sleeve 252 in a first position in which it is tilted by an angle $\alpha$ counterclockwise relative to hosel 258. FIG. 29B illustrates shaft sleeve 252 in a second position in which shaft sleeve 252 is aligned with a longitudinal axis of hosel 258. FIG. 29C illustrates shaft sleeve 252 in a third position in which shaft sleeve 252 is tilted by an angle $\alpha$ clockwise relative to hosel 258.

The outer diameter of the portion of shaft sleeve 252 that extends into hosel 258 is selected so that so that clearance is provided between shaft sleeve 252 and an internal surface of hosel 258 for the desired tilt angular travel. Additionally, the size of bores 276, 278 are selected so that clearance is provided for fastener 256 throughout the range of motion of shaft sleeve 252.

An alignment member 280 is provided in a fastener bore 281 provided in a sole of golf club head 260. Alignment member 280 may be used to retain fastener 256 so that shaft sleeve 252 is maintained in a selected orientation. A plurality of alignment members may be provided, each configured to align fastener 256 and shaft sleeve 252 in a particular orientation. In the present embodiment, a pair of alignment members 280 is provided. A first alignment member 280*a* is provided for the orientations of shaft sleeve 252 illustrated in FIGS. 29A and 29C, and alignment member 280*a* includes an alignment bore 282 that is located near a side edge of alignment member 280*a* and angled toward the center of rotation of shaft sleeve 252. Alignment member 280*a* is rotated 180° to accommodate the different orientations of FIGS. 29A and 29C. In FIG. 29B, alignment member 280*b* is illustrated, which includes an alignment bore 282 that is located at the center of alignment member 280*b* and orients fastener 256 and shaft sleeve 252 so that they are generally aligned along a longitudinal axis of hosel 258.

Figures 30A, 30B, 30C, 30D:
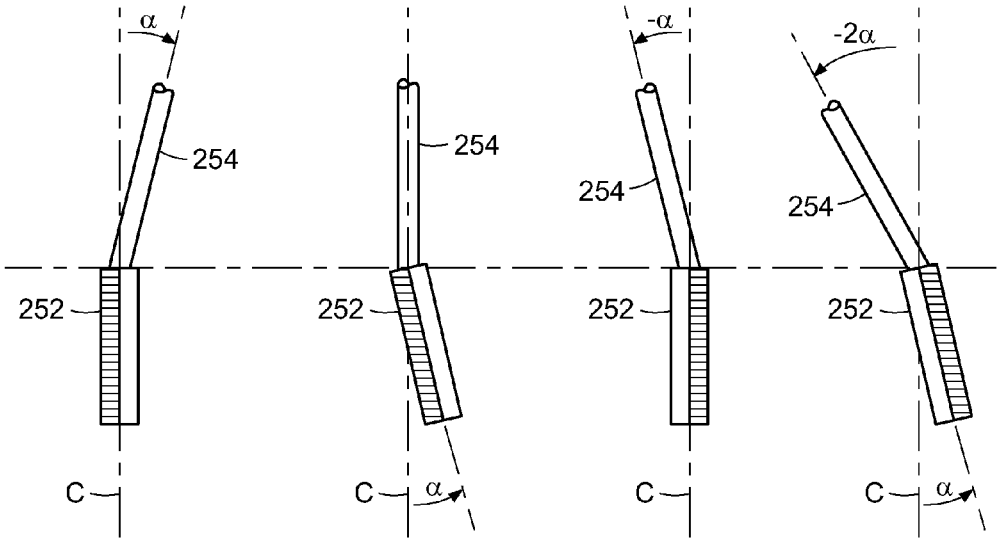
FIGS. 30A-D are schematic views of illustrating an interchangeable shaft system in various configurations.

The adjustability provided by interchangeable shaft system 250 is illustrated schematically in FIGS. 30A-30D. Shaft sleeve 252 is permitted to tilt within a hosel 258 and shaft sleeve 252 is able to rotate 180° relative to hosel 258. Additionally, shaft 254 is mounted in shaft sleeve 252 at a shaft angle $\alpha$ relative to the longitudinal axis of shaft sleeve 252. As a result, the range of angular travel of shaft 254 relative to the longitudinal axis of hosel 258 is increased relative to a system that does not allow tilting. For example, in a first orientation, shown in FIG. 30A, shaft 254 is oriented in a clockwise position, at an angle $\alpha$ relative to a longitudinal axis C of hosel 258, and shaft sleeve 252 is oriented coaxially with hosel 258. In a second orientation, illustrated in FIG. 30B, shaft sleeve 252 is tilted counterclockwise, at an angle $\alpha$ relative to axis C, which results in shaft 254 being aligned co-axially with axis C. In FIG. 30C, shaft sleeve 252 is rotated 180° about axis C, when compared to the orientations of FIGS. 30A & 30B, and is aligned coaxially with axis C so that shaft 254 is oriented in a counterclockwise position, at an angle $-\alpha$ relative to axis C. By tilting shaft sleeve 252 counterclockwise relative to hosel by an angle $\alpha$, the orientation of shaft 254 is changed so that shaft 254 is rotated further away from axis C to a counterclockwise orientation an angle of $-2\alpha$ relative to axis C. By configuring shaft sleeve 252 to tilt and rotate, additional shaft orientations are achievable. Additionally, in such a configuration the angular travel of the shaft is greater than the angular travel required for the shaft sleeve within the hosel. Additionally, by allowing the tilting of shaft sleeve 252 all of the shaft orientations may be provided in a single plane, such as a lie plane.

Figure 32:
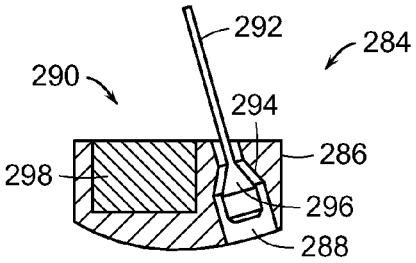
FIG. 32 is a cross-sectional view, taken along line 32-32 of the alignment member of FIG. 31.
Figure 31:
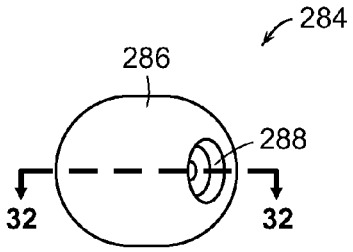
FIG. 31 is a side view of an alignment member of an interchangeable shaft system in accordance with the present invention.

The alignment member included in the interchangeable shaft system may have various configurations. In an embodiment, shown in FIGS. 31 and 32, alignment member 284 includes a body 286 that includes an alignment bore 288 and a weight cavity 290. As described previously with regard to other embodiments, alignment hole 288 is configured to align a fastener 292 that extends into a shaft sleeve and retains the shaft sleeve in a desired orientation relative to a hosel of a golf club head. In the present embodiment, alignment bore 288 includes a tapered portion 294 that abuts a tapered portion 296 of fastener 292 so that fastener 292 is wedged into a particular orientation.

Weight cavity 290 may be used to include a separate weight member 298 or may be left empty to reduce the weight of alignment member 284. A weight member 298 may be included to alter the swing weight of a golf club head including alignment member 284 and by including weight member 298 in alignment member 284, the additional weight is located near the shaft axis. Such a location provides alternate swing weights while having minimal impact on the moment of inertia about the shaft axis so that it does not significantly impact the ability to rotate the club about the shaft axis. Additionally, the additional weight is located adjacent the sole which is generally preferred to avoid raising the center of gravity of the golf club head.

Figure 34:
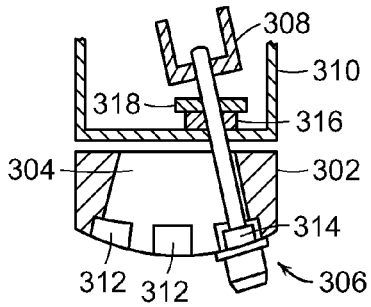
FIG. 34 is a cross-sectional view, taken along line 34-34, of the alignment member of FIG. 33.
Figure 33:
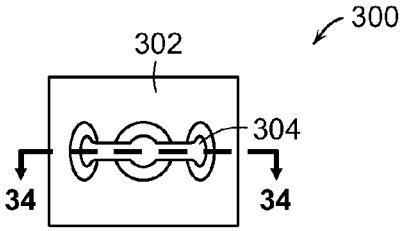
FIG. 33 is a side view of another embodiment of an alignment member of an interchangeable shaft system.

Another alignment member is shown in FIGS. 33 and 34. Alignment member 300 includes a body 302 that defines a slot 304 that accommodates a plurality of orientations of fastener 306. Fastener 306 extends through slot 304 and engages a shaft sleeve 308 that is located in a hosel 310 of a golf club head. As shown in FIG. 34, slot 304 includes a plurality of détente positions that are created by counterbores 312 that intersect slot 304 and that receive a shoulder 314 included on fastener 306. Such a configuration allows the orientation of fastener 306 and shaft sleeve 308 to be altered without fully disengaging fastener 306 from shaft sleeve 308 by retracting fastener 306 enough that shoulder 314 is disengaged from counterbore 312.

Figure 35:
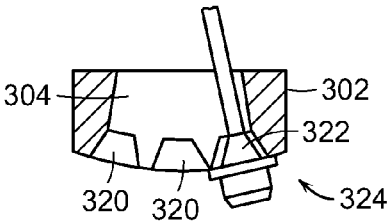
FIG. 35 is an alternative cross-sectional view, taken along line 34-34, of the alignment member of FIG. 33.

As an alternative, a compressible member 316, such as a compressible washer or sleeve, and a limit stop 318 may be disposed on fastener 306 between shaft sleeve 308 and hosel 310. Compressible member 316 is compressed between limit stop 318 and hosel 310 when fastener 306 is retracted and urges shoulder 314 to remain in a counterbore 312 to assist in positioning fastener 306 during use. In another embodiment, shown in FIG. 35, the counterbores may be replaced by countersinks 320 and a fastener 324 having a tapered portion 322 may be included. Utilizing countersinks 320 and a tapered fastener 324 may provide an additional advantage that the engagement between the features causes fastener 324 and shaft sleeve 308 to be self-locating at a desired orientation.

Figure 37:
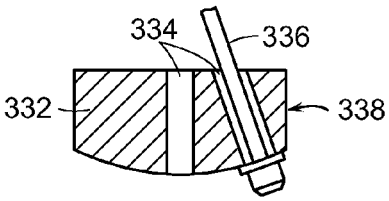
FIG. 37 is a cross-sectional view, taken along line 37-37, of the alignment member of FIG. 36.
Figure 36:
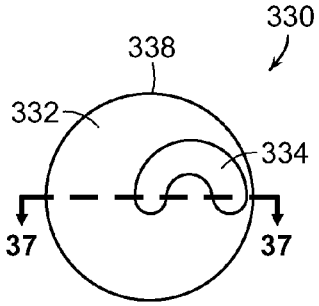
FIG. 36 is a side view of another embodiment of an alignment member of an interchangeable shaft system.

Referring to FIGS. 36 and 37, alignment member 330 includes a body 332 having a circular cross-sectional shape.

Body 332 defines an arcuate slot 334 that receives fastener 336. Arcuate slot 334 is configured so that fastener may be oriented between the center of alignment member 330 and the edge of alignment member by rotating alignment member 330 within a fastener bore while fastener 336 remains engaged with a shaft sleeve. A side wall 338 of body 332 may include a coating or surface features, such as knurling, that provide friction between body 332 and the fastener bore so that alignment member 330 does not freely rotate within the fastener bore.

The shape of the alignment member and the fastener bore are selected to provide desired mobility. The body of alignment member may have a cross-sectional shape that allows it to be received in the fastener bore in one of a plurality of orientations, such as by being shaped as an oval, a star, a polygon or any other shape that allows that mobility. Alternatively, the body of the alignment member may be circular in cross-section so that it may be rotated within the fastener bore to allow continuous adjustment. As a still further alternative, the body of the alignment member may be shaped so that there is only one possible orientation within the fastener bore, such as by making the alignment member asymmetrically shaped.

Figure 38:
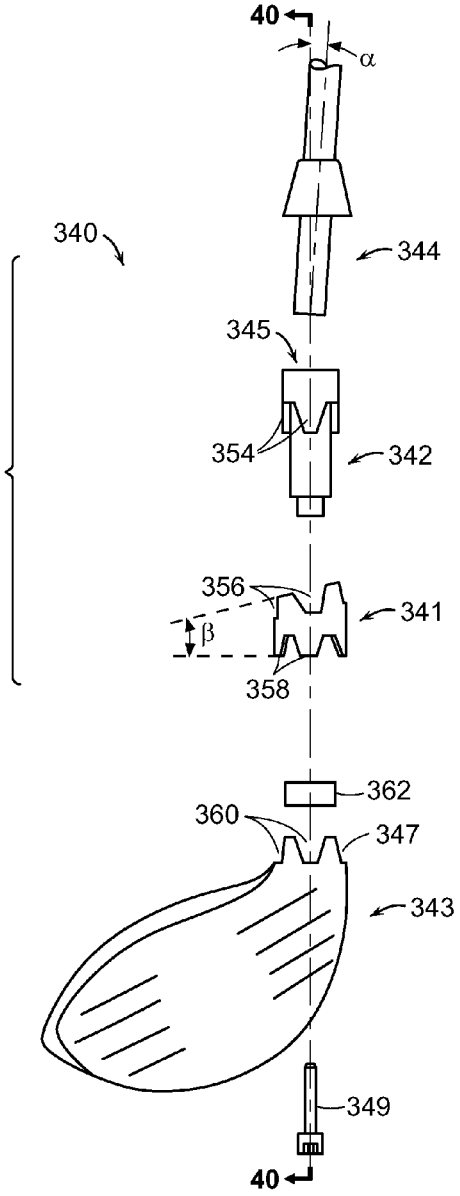
FIG. 38 is an exploded view of a golf club including another embodiment of the interchangeable shaft system of the present invention.
Figure 39:
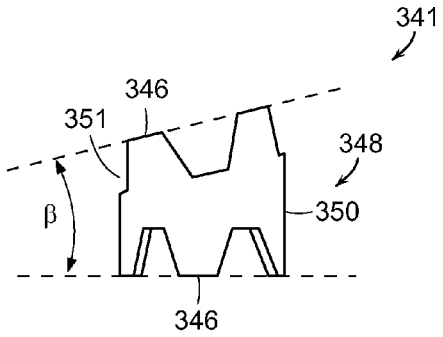
FIG. 39 is a side view of a side view of a wedge member included in the interchangeable shaft system of FIG. 38.
Figure 40:
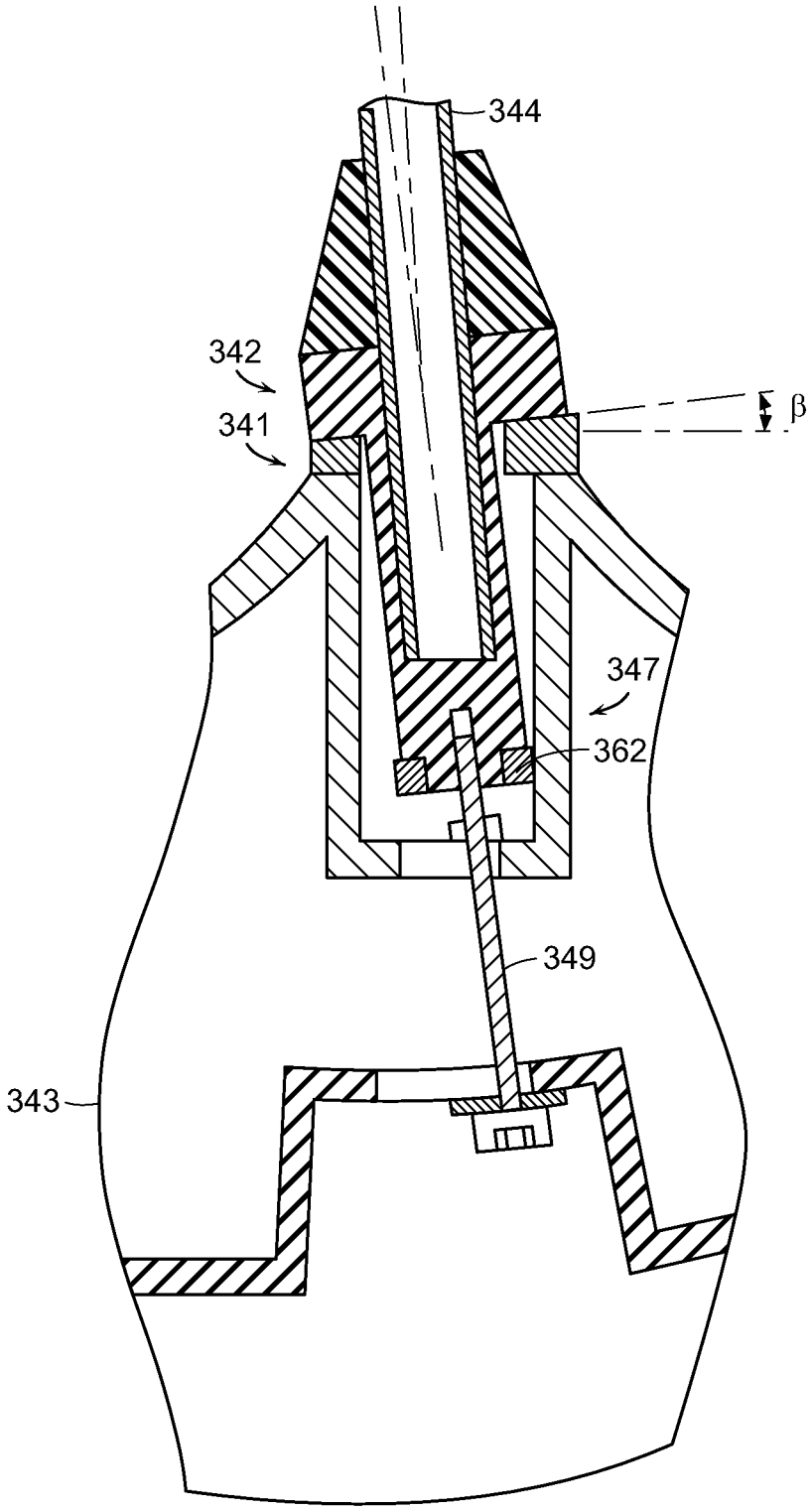
FIG. 40 is a cross-sectional view taken along line 40-40, shown in FIG. 38.

Referring to FIGS. 38-40, another embodiment of an interchangeable shaft system 340 will be described that provides dual angle adjustability. Interchangeable shaft system 340 is configured to provide additional adjustability to the system by including a wedge member 341 that is interposed between a shaft sleeve 342 and a hosel 347 of club head body 343. In particular, shaft sleeve 342 is coupled to a shaft 344, extends through wedge member 341 and is at least partially received within hosel 347. A fastener 349 releasably couples sleeve 342 to club head 343.

In an embodiment, shaft sleeve 342 includes a shaft bore 345 that has a longitudinal axis that is not coaxial with the body of shaft sleeve 342 so that when shaft sleeve 342 is coupled to the distal end of shaft 344, the longitudinal axis of shaft sleeve 342 is angled relative to the longitudinal axis of shaft 344 by shaft angle $\alpha$. As described herein, the maximum angular deflection plane of the shaft sleeve 342 is a cross-sectional plane that extends through the longitudinal axis of shaft sleeve 342 and through the central axis of shaft bore 345 so that the greatest angular difference between shaft sleeve 342 and shaft 344 when it is inserted into shaft bore 345 is coincident with that plane. Shaft angle $\alpha$ is preferably less than about 10°, and more preferably less than about 5°.

Opposite end surfaces 346 of wedge member 341 are angled relative to each other so that when wedge member 341 is interposed between shaft sleeve 342 and hosel 347, the orientation of shaft 344 relative to club head 343 is defined by a combination of the positions of wedge member 341 relative to club head 343 and shaft sleeve 342 relative to club head 343.

Wedge member 341 includes a cylindrical tubular body 348 that has planar end surfaces 346 that are angled relative to each other by a wedge angle $\beta$ so that the surfaces are non-parallel and the alignment features extending away from those surfaces are angled relative to each other. Wedge angle $\beta$ is preferably less than about 10°, and more preferably less than about 5° and less than shaft angle $\alpha$. In the present embodiment, a distal end surface of wedge member 341 is generally normal to the longitudinal axis of cylindrical body 348 and a proximal end surface is angled relative to the longitudinal axis of cylindrical body 348. As a result, wedge member has a maximum length portion 350 that is approximately diametrically opposed to a minimum length portion 351 and wedge member 341 defines a maximum angular deflection plane. As described herein, the maximum angular deflection plane of the wedge member is a cross-sectional plane that extends across the wedge member and through the minimum length portion and maximum length portion so that the greatest angular difference between the proximal end surface and the distal end surface of the wedge is coincident with that plane. For example, as shown in FIG. 39, wedge member 341 has a maximum angular deflection plane that corresponds to the plane of the paper.

Shaft sleeve 342 is inserted into wedge member 341 and into hosel 347 so that the three components have a desired relative orientation. The plurality of alignment features included on shaft sleeve 342, wedge member 341 and hosel 347 provide a plurality of discrete orientations of the shaft relative to the club head. In the illustrated embodiment, the alignment features are configured so that there are four discrete relative orientations between wedge member 341 and hosel 347 and four discrete relative orientations between shaft sleeve 342 wedge member 341. In particular, the alignment features of shaft sleeve 342 include four tangs 354 equally spaced circumferentially around shaft sleeve 342. Tangs 354 are sized and shaped to complement notches 356 included in a proximal end of wedge member 341. The distal end of wedge member 341 includes alignment features, e.g., four tangs 358, that are sized and shaped to complement alignment features included in a proximal end of hosel 347, e.g., notches 360. In the assembled interchangeable shaft system 340, tangs 354 of shaft sleeve 342 are engaged with notches 356 of wedge member 341 and tangs 358 of wedge member 341 are engaged with notches 360 of hosel 347.

After shaft sleeve 342 is inserted into wedge member 341, retainer 362 is coupled to shaft sleeve 342 so that wedge member 341 is retained on shaft sleeve 342. Retainer 362 is coupled to a distal end of shaft sleeve 342 so that wedge member 341 is permitted to slide between retainer 362 and tangs 354. As a result, the loft and lie orientation of shaft 344 relative to golf club head 343 may be changed without fully disassembling interchangeable shaft system 340 and it prevents loss of wedge member 341 if the system is fully disassembled. For example, the length of engagement of fastener 349 may be selected to be greater than the length of engagement of each of the sets of alignment features so that components of interchangeable shaft system 340 may be reoriented without fully disassembling the system.

In another embodiment, the shaft sleeve includes a shaft bore that has a longitudinal axis that is coaxial with the body of the shaft sleeve. In such an embodiment, a wedge member provides angular adjustability while maintaining the rotational position of the shaft and grip. As a result, directional shafts and grips may be maintained in a desired orientation. Directional shafts include those with physical attributes, such as stiffness, kick point, etc., that depend on the direction and location of the forces placed on the shaft or those with asymmetric graphics. Directional grips include those with visible or tactile orientation reminders, often referred to as reminder grips.

The magnitudes of shaft angle $\alpha$ and wedge angle $\beta$ and the location and number of alignment features are selected so that a desired range of motion and number of discrete orientations may be provided. For example, in embodiments in which the maximum angular displacement plane of the combined shaft sleeve and shaft and the maximum angular displacement plane of the wedge member may be aligned, the magnitude of the range of angular motion is provided by the addition of shaft angle $\alpha$ and wedge angle $\beta$ and the number of discrete orientations depends on whether shaft angle $\alpha$ has the same magnitude as wedge angle $\beta$.

Figure 41A:
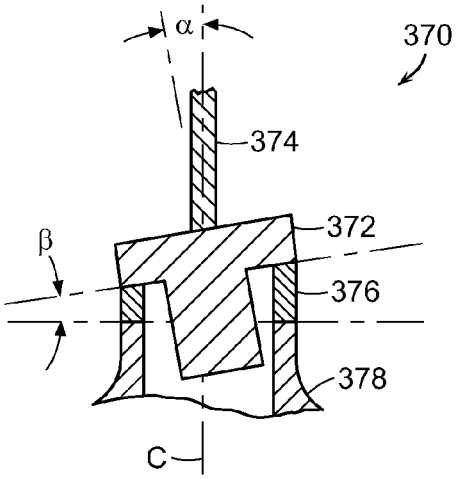
FIGS. 41A-41D are schematics of the angular relation between a shaft and a hosel in embodiments of the interchangeable shaft system of the present invention.
Figure 41B:
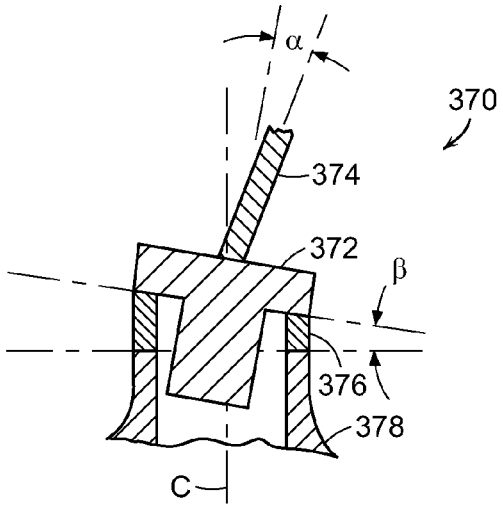

In shown in FIGS. 41(A)-41(D), the maximum angular deflection plane of the wedge member and the maximum angular deflection plane of the combined shaft sleeve and shaft are oriented so that they are aligned with the plane of the page. Referring to FIGS. 41(A) and 41(B), an interchangeable shaft system 370 includes a shaft sleeve 372, a shaft 374, and a wedge member 376 that are coupled to a hosel 378 of a golf club head. Wedge member 376 includes end surfaces that are angled relative to each other at a wedge angle β and shaft 374 is angled relative to shaft sleeve 372 by a shaft angle α that has the same magnitude as wedge angle β. Additionally, the alignment features of shaft sleeve 372 and wedge member 376 are configured so that the maximum deflection planes may be co-planar, or parallel. As a result, and as shown in FIG. 41(A), in some orientations, the angular deflection of wedge member 376 cancels the angular deflection of shaft sleeve 372 so that shaft 374 is coaxial, or parallel, with a longitudinal axis C of hosel 378. The cancellation of the angular deflection results in multiple positions of the combined shaft sleeve 372 and wedge member 376 creating a duplicate shaft orientation. In other orientations, as shown in FIG. 41(B), the angular deflection of shaft 374 relative to longitudinal axis C of hosel 378 is the sum of wedge angle β and shaft angle α.

Figure 41C:
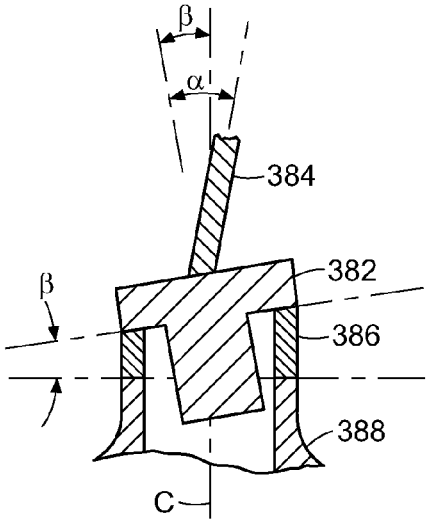
Figure 41D:
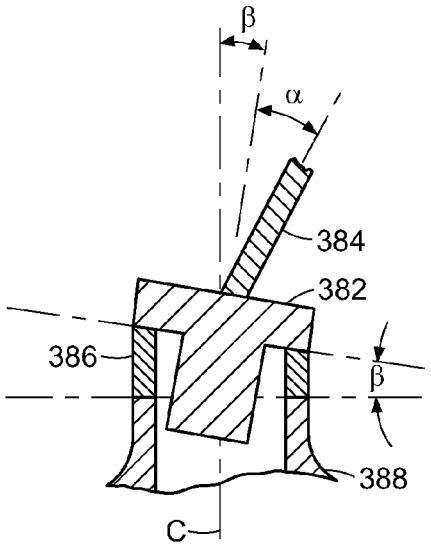

Referring to FIGS. 41(C) and 41(D), another interchangeable shaft system 380 includes a shaft sleeve 382, a shaft 384, and a wedge member 386 that are coupled to a hosel 388 of a golf club head. Wedge member 386 includes end surfaces that are angled relative to each other at a wedge angle β and shaft 384 is angled relative to shaft sleeve 382 by a shaft angle α that has a different magnitude than wedge angle β. In embodiments in which the alignment features of shaft sleeve 382 and wedge member 386 are configured so that the maximum deflection planes may be co-planar, or parallel, the different magnitudes of angular deflection provide some orientations in which the angular deflections are additive and some in which the angular deflections are subtractive, but do not fully cancel. As shown in FIG. 41(C), the angular deflection of shaft 384 relative to longitudinal axis C of hosel 388 is the difference of wedge angle β and shaft angle α. In other orientations, as shown in FIG. 41(D), the angular deflection of shaft 384 relative to longitudinal axis C of hosel 388 is the sum of wedge angle β and shaft angle α.

Figure 2:
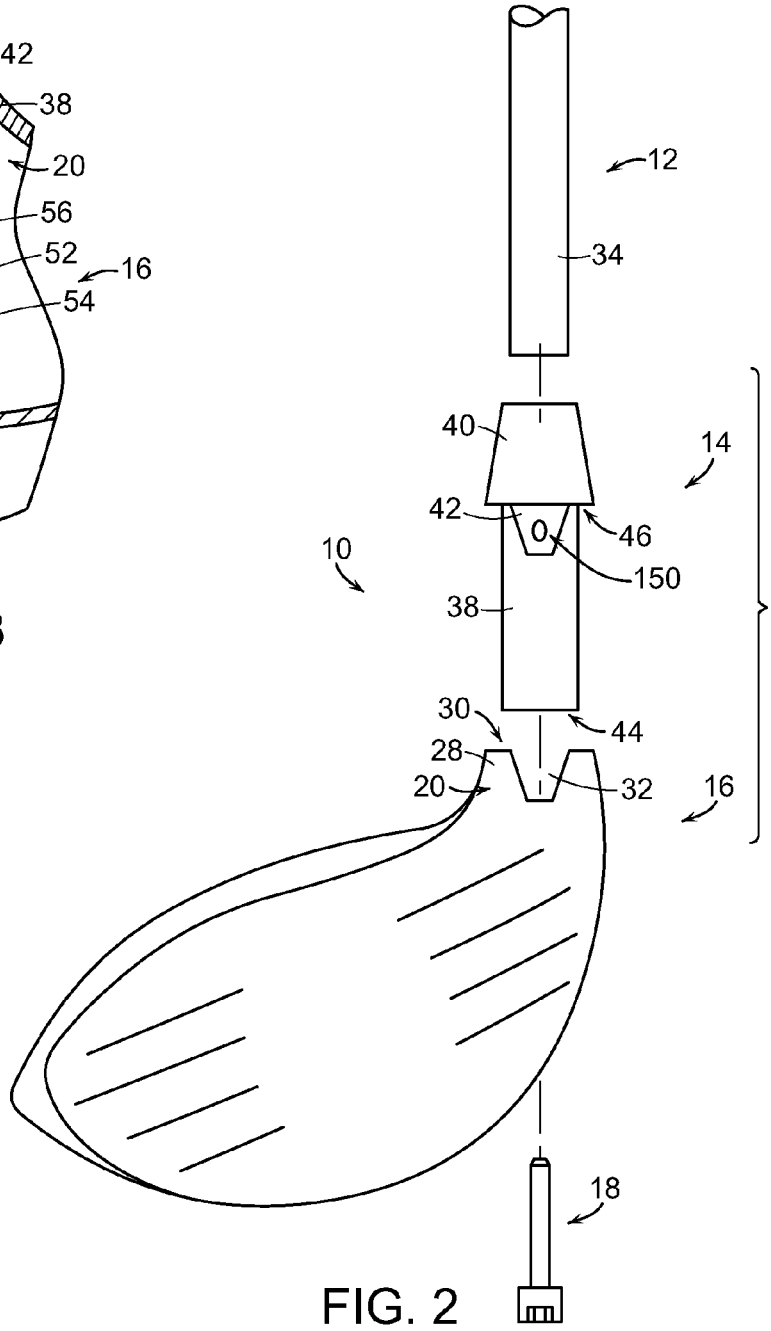
FIG. 2 is an exploded view of the golf club of FIG. 1.
Figure 4:
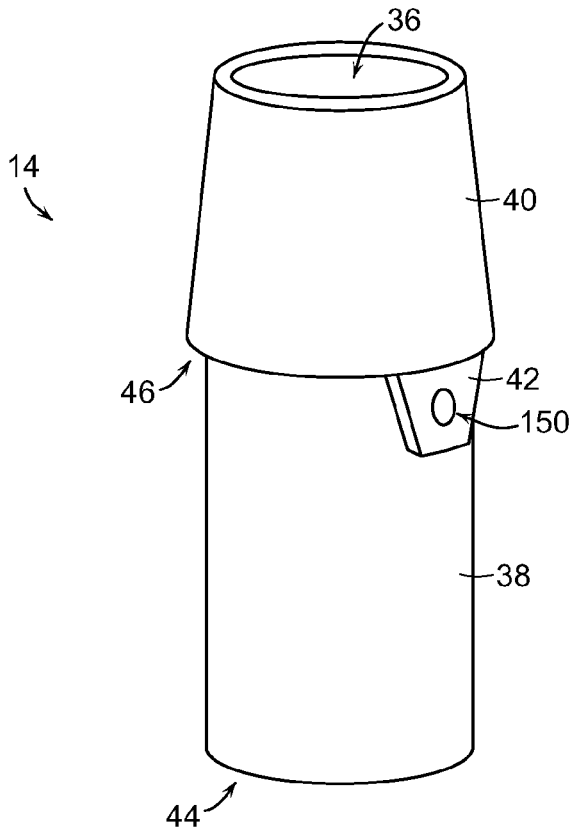
FIG. 4 is a perspective view of a shaft sleeve of the interchangeable shaft system.
Figure 5:
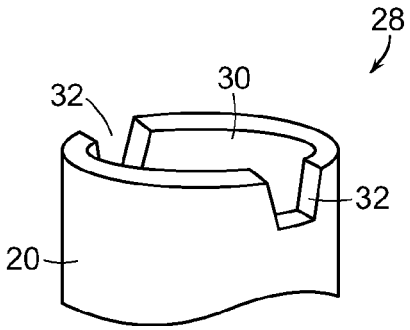
FIG. 5 is a perspective view of a proximal end portion of the hosel of the golf club of FIG. 1.

The number and location of the alignment features of the shaft sleeve, the wedge member, and/or the hosel of the embodiments of the interchangeable shaft system of the present invention may be oriented so that the maximum deflection plane may have any predetermined orientation relative to the club head. As a result, the patterns presented by the available orientation positions of the shaft relative to the club head may be altered to provide a desired adjustability pattern. For example, to provide an embodiment having two available orientations with different face angles and constant lie angle an interchangeable shaft system, such as that shown in FIGS. 1-3 is constructed with the maximum displacement plane of the shaft sleeve aligned along a 0° plane of the club head (i.e., plane D of FIG. 42) and the shaft sleeve may be rotated so that the shaft is deflected toward the 0° orientation or toward the 180° orientation.

In another example, an interchangeable shaft system is provided that has two available orientation positions in which only the lie angle is altered. Such an embodiment may be incorporated into any type of golf club, but it may be especially beneficial for an iron-type golf club because during fitting it is often desired to alter the lie angle without altering the loft angle so that the ball flight distance gaps between irons are maintained. In such an embodiment, an interchangeable shaft system, such as that shown in FIGS. 1-3 is constructed with the maximum displacement plane of the shaft sleeve aligned along a 90° plane of the club head (i.e., plane F of FIG. 42).

Figure 42:
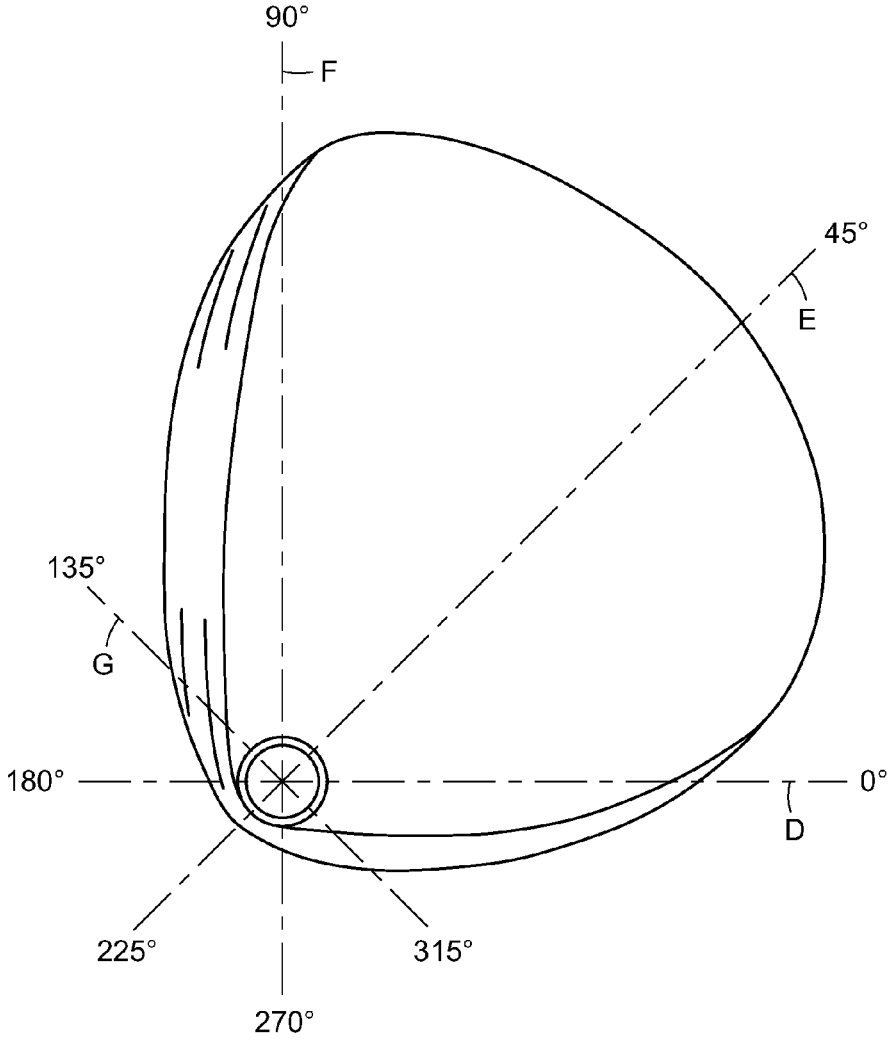
FIG. 42 is a top view of a golf club head.
Figure 43:
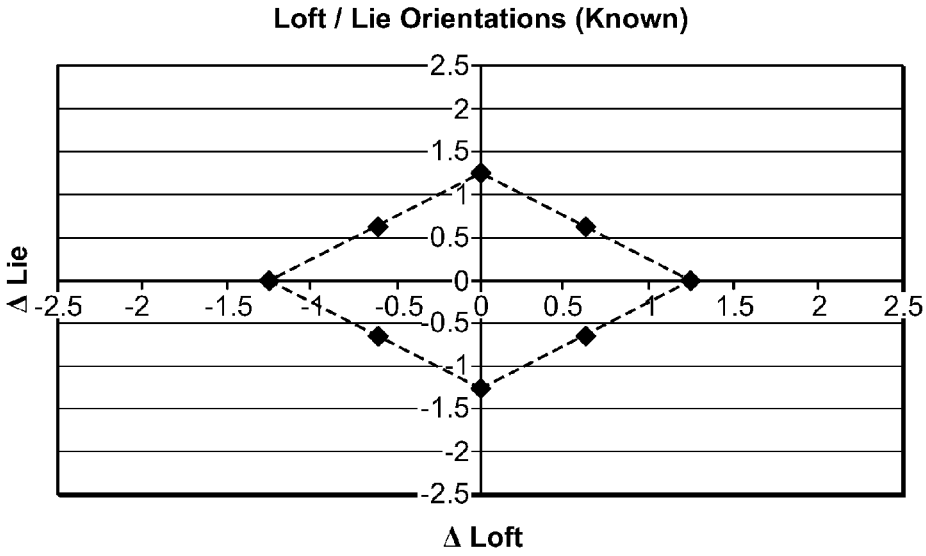
FIG. 43 is a chart illustrating the loft and lie orientations of a known adjustable shaft system.
Figure 44:
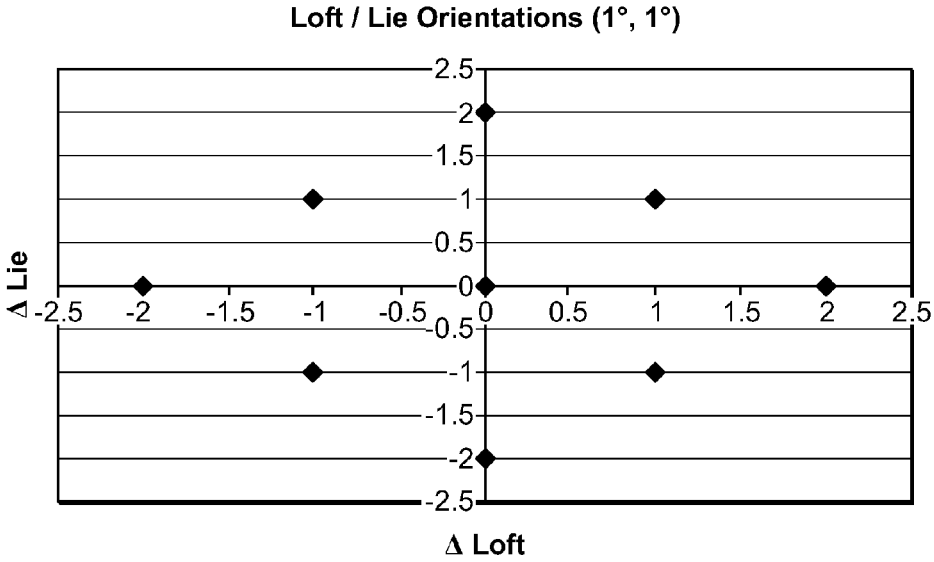
FIG. 44 is a chart illustrating the loft and lie orientations of an embodiment of an adjustable interchangeable shaft system of the present invention.

Referring to FIGS. 44-48, changes in loft and lie orientation from nominal, or designed, values for embodiments having various orientations of the maximum deflection planes and magnitudes of the angular deflection of the wedge member and the shaft relative to the shaft sleeve will be described. In each of the embodiments, the alignment features are configured so that there are four relative positions between the shaft sleeve and the wedge member, and between the wedge member and the hosel, but it should be appreciated that more or fewer relative alignment positions may be provided between the components. FIG. 44 illustrates loft and lie orientations provided by an embodiment of the interchangeable shaft system. In the embodiment, a wedge member and shaft sleeve each provide an angular deflection of 1° and the alignment features are configured so that the maximum displacement planes may be oriented along planes D and/or F, as shown in FIG. 42. Because of the magnitude of the angular displacement of the components and the possible orientations of the maximum displacement planes, the orientations generally form a diamond-shaped matrix on a plot of change in loft (A loft) to change in lie (Δ lie) that includes at least one interior orientation. Unlike known systems, however, the combination of components with the same displacement magnitude and the ability to orient those components so that the displacement cancels, provides a neutral position having no change in loft or lie from the designed values. Additionally, the combination of components also provides interior positions within a matrix, unlike the perimetric matrices offered in known systems.

Figure 45:
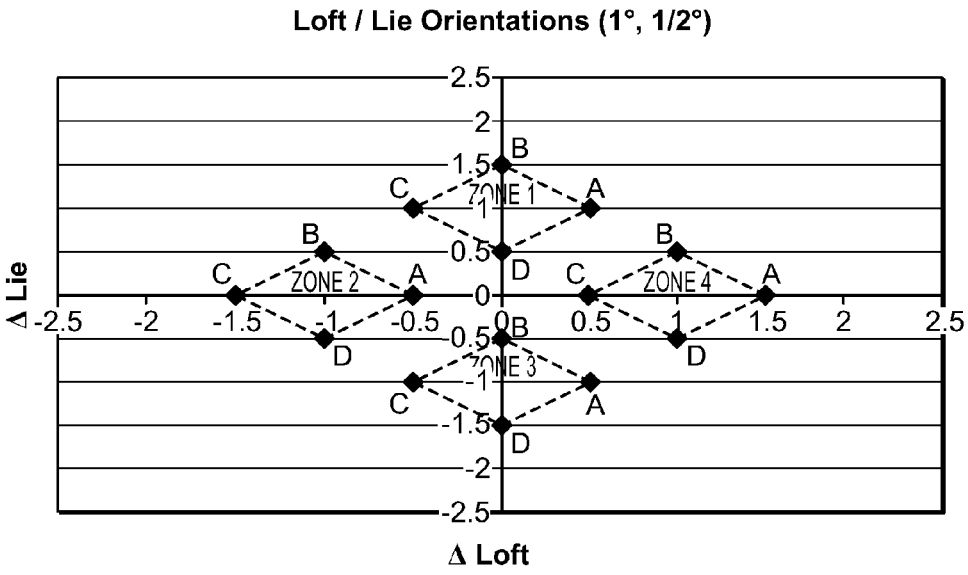
FIG. 45 is a chart illustrating the loft and lie orientations of another embodiment of an adjustable interchangeable shaft system of the present invention.

In another embodiment, a system having a wedge member and a shaft sleeve with different magnitudes of angular displacement are provided which provides additional loft and lie orientations, as illustrated in FIG. 45. The wedge member provides angular displacement of 0.5° and the shaft sleeve provides angular displacement of 1° and the alignment features are configured so that the planes of maximum angular displacement of the wedge and the shaft sleeve may be oriented along planes D and/or F of FIG. 42. Because the magnitude of the displacement is different for the wedge member and the shaft sleeve, sixteen (16) discrete positions are provided of the shaft relative to the club head having the Δ loft and Δ lie combinations shown.

The available orientations of the planes of maximum angular displacement may be altered, as compared to the previous embodiments, to provide a rectangle-shaped orientation matrix that provides interior orientations. Preferably, the loft values are the same for each available lie value in the matrix, as provided by the embodiments illustrated in FIGS. 46-48. Such a configuration is especially beneficial because it provides multiple orientations in which one of loft and lie may be adjusted while keeping the other approximately constant. In particular, a system having a wedge member and a shaft sleeve with alignment features configured to be oriented on 45° and 135° planes (i.e., planes E and G of FIG. 42) provides loft and lie orientations having a rectangular shaped matrix.

Figure 46:
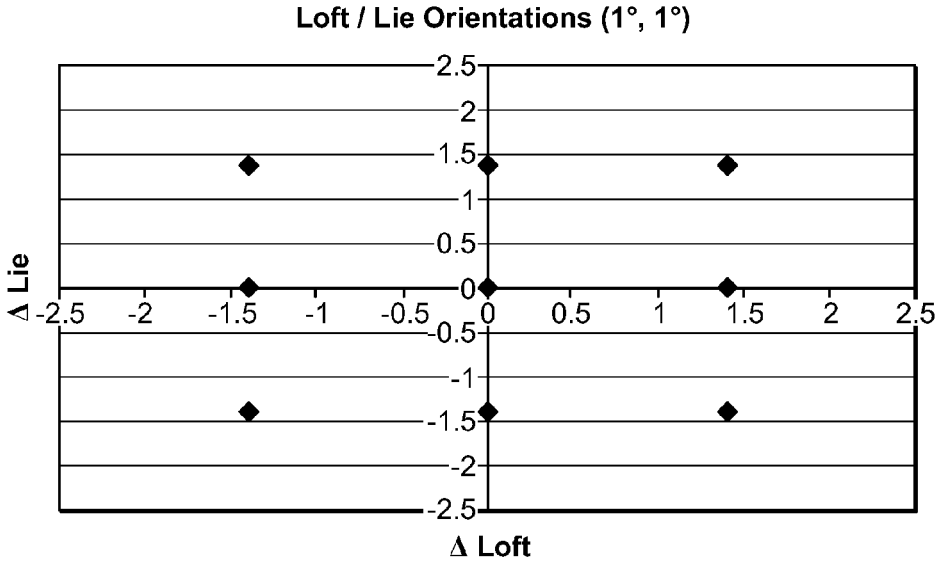
FIG. 46 is a chart illustrating the loft and lie orientations of another embodiment of an adjustable interchangeable shaft system of the present invention.

Referring to FIG. 46, an embodiment having a wedge member and a shaft sleeve with the same magnitudes of angular displacement. In this particular embodiment, the wedge member and the shaft sleeve each have angular displacement with a magnitude of about 1.0°. The alignment features of each of those components are configured so that the planes of maximum angular deflection for each of the members may be aligned with planes E and/or G of FIG. 42.

The combination of orientation and magnitude provide adjustability within a 3×3 square matrix of different available loft and lie orientations. It should be appreciated that the cumulative behavior of the wedge member and shaft sleeve having the same magnitude results in a plurality of loft and lie orientations that are repeated (i.e., different combinations of the orientations of the wedge member and shaft sleeve result in duplicated configurations of the golf club).

Figure 47:
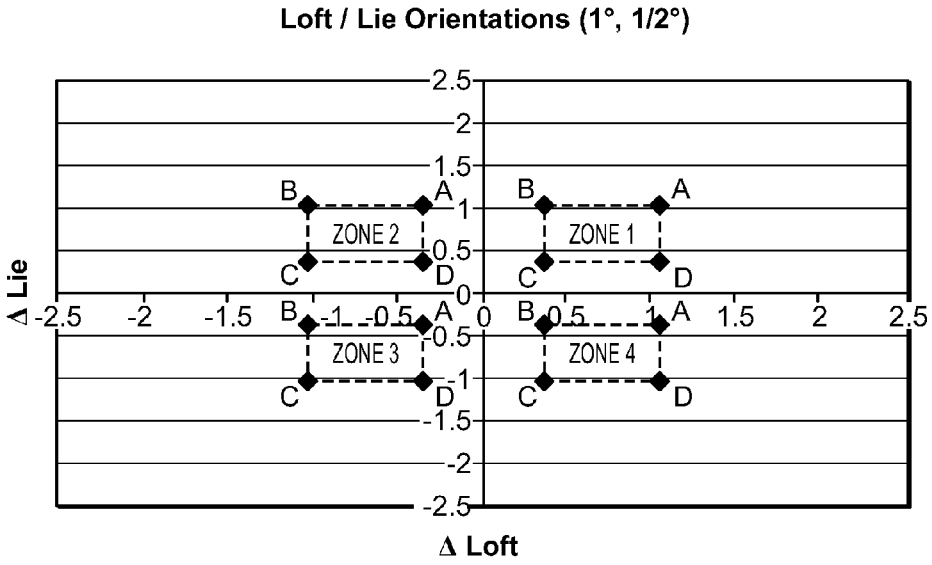
FIG. 47 is a chart illustrating the loft and lie orientations of another embodiment of an adjustable interchangeable shaft system of the present invention.
Figure 48:
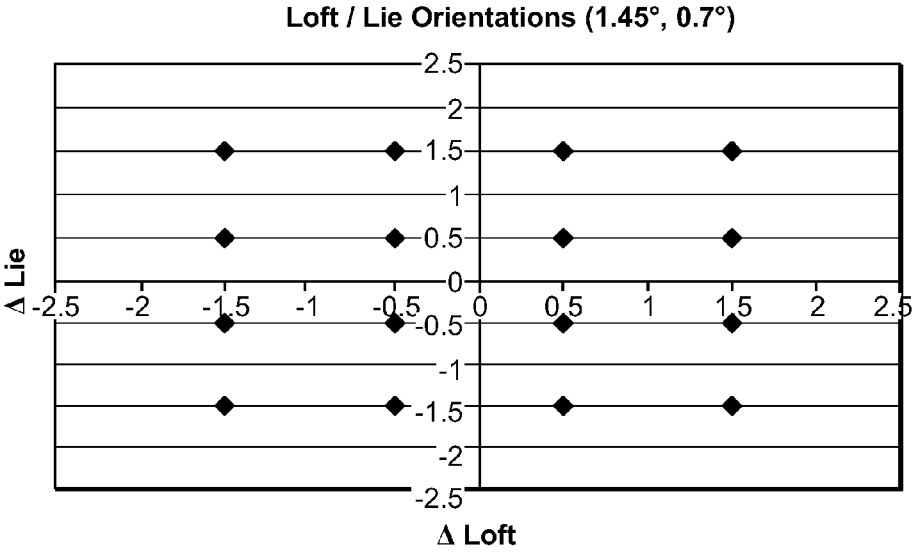
FIG. 48 is a chart illustrating the loft and lie orientations of another embodiment of an adjustable interchangeable shaft system of the present invention.

Referring to FIGS. 47 and 48, loft and lie orientations of two embodiments having a wedge member and a shaft sleeve with different magnitudes of angular displacement are illustrated. In particular, the embodiment of FIG. 47 includes a wedge member providing angular displacement of about 0.5° and a shaft sleeve providing angular displacement of about 1.0°. The alignment members are configured so that the planes of maximum angular deflection for each of the members may be aligned with planes E and/or G of FIG. 42. The combination of orientation and magnitude provide adjustability within a 4×4 square matrix of available discrete loft and lie orientations. In the embodiment of FIG. 48, a wedge member provides angular displacement of about 0.7° and a shaft sleeve provides angular displacement of about 1.45° and the planes of maximum angular displacement may be oriented on planes E and/or G of FIG. 42. In embodiments incorporating different magnitudes of angular displacement, it is preferable that the magnitude of angular displacement of the wedge member is less than the magnitude of angular displacement of the shaft sleeve so that movement of the fastener head is reduced.

Figure 49:
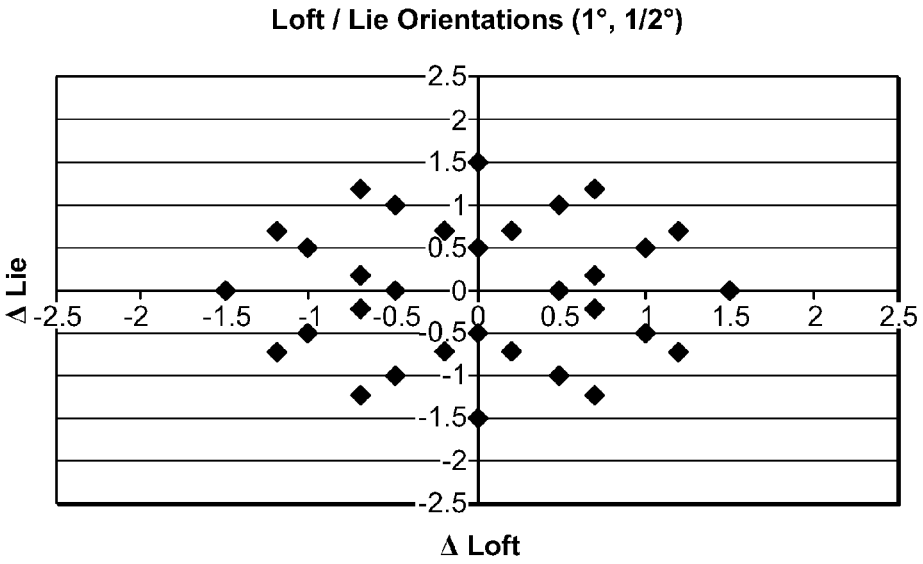
FIG. 49 is a chart illustrating the loft and lie orientations of another embodiment of an adjustable interchangeable shaft system of the present invention.
Figure 50:
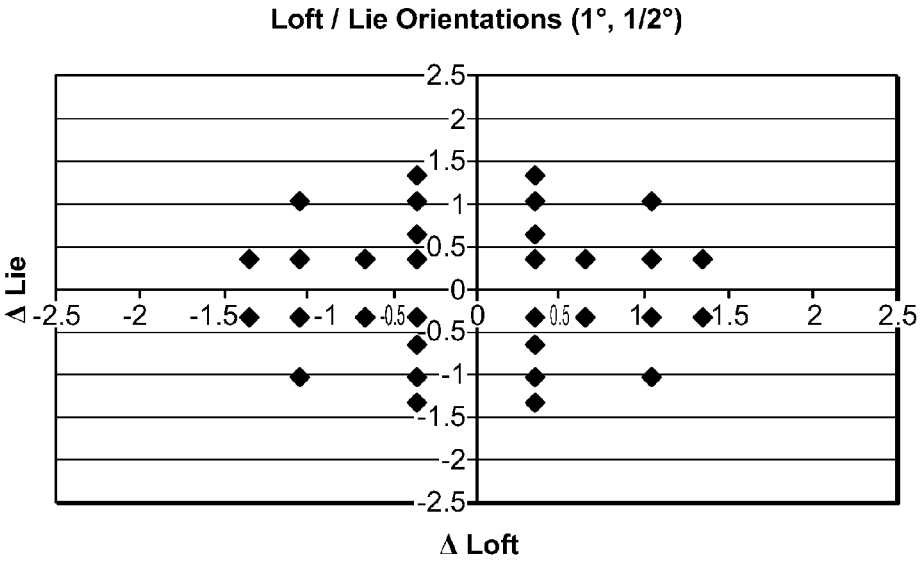
FIG. 50 is a chart illustrating the loft and lie orientations of another embodiment of an adjustable interchangeable shaft system of the present invention.

Referring to FIGS. 49 and 50, loft and lie orientations of additional embodiments having a wedge member and a shaft sleeve with different magnitudes of angular displacement are illustrated. The embodiments include a wedge member providing angular displacement of about 0.5° and a shaft sleeve providing angular displacement of about 1.0°. In addition, the number of positions available for each component is different, for example, in these embodiments, the wedge member may be placed in four orientations relative to the hosel and the shaft sleeve may be placed in eight orientations relative to the wedge member. In the embodiment of FIG. 49, the wedge member may be oriented so that the plane of maximum angular displacement of the wedge member may be oriented along planes D and/or F of FIG. 42. In the embodiment of FIG. 50, the wedge member may be oriented so that the plane of maximum angular displacement of the wedge member may be oriented along planes E and/or G of FIG. 42. Because the shaft sleeve may be oriented in any of eight positions spaced about the circumference, in both embodiments the plane of maximum angular displacement of the shaft sleeve may be oriented along planes D, E, F and/or G of FIG. 42.

Figure 51:
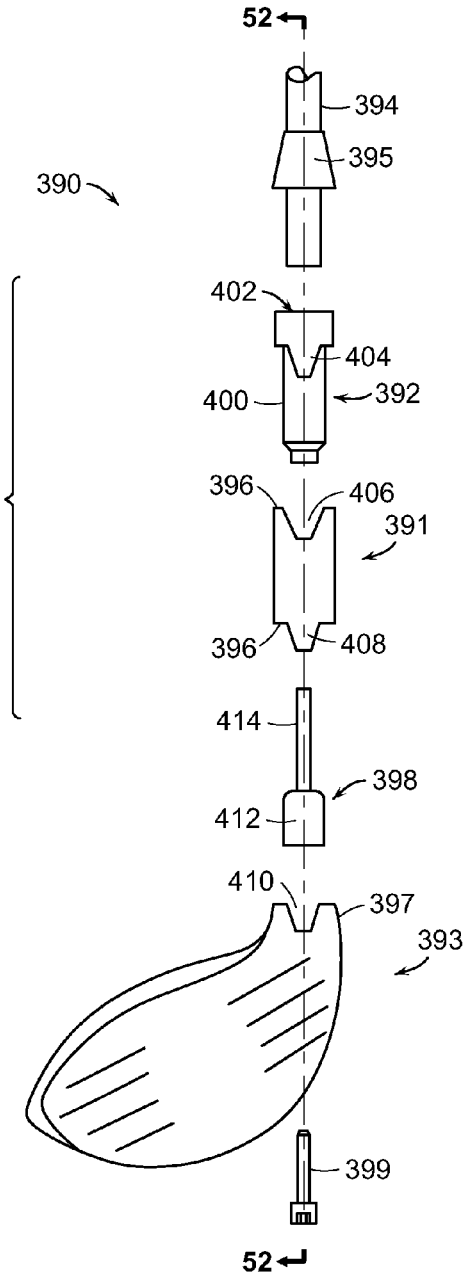
FIG. 51 is an exploded view of a golf club including another embodiment of the interchangeable shaft system of the present invention.
Figure 52:
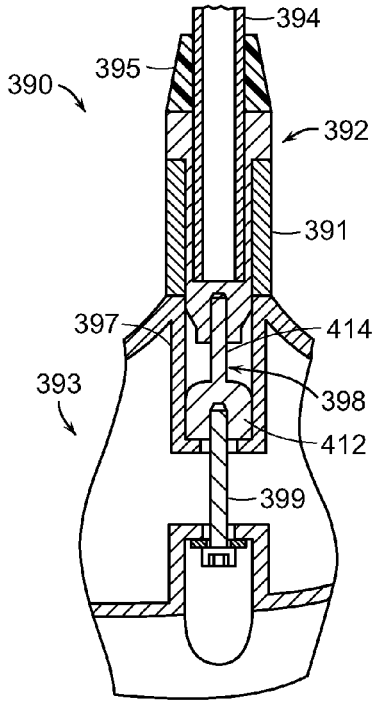
FIG. 52 is a cross-sectional view taken along line 52-52, shown in FIG. 51.

Referring to FIGS. 51 and 52, an interchangeable shaft system 390 that provides overall club length adjustment will be described. In system 390, extension member 391 is substituted for a wedge member, or wedge members having different lengths may be provided. Generally, system 390 includes a shaft sleeve 392 that is coupled to a shaft 394, and shaft sleeve 392 extends through extension member 391 and is partially received within a hosel 397 of club head 393, although in some embodiments utilizing a longer extension member 391 the shaft sleeve 392 may not be received within hosel 397. A fastener 399 releasably couples sleeve 392 to club head 393 through a fastener extension 398. A ferrule 395 is disposed on shaft 394 adjacent a proximal end of shaft sleeve 392.

Shaft sleeve 392 includes a body 400 and a plurality of alignment features (e.g., tangs 404). Body 400 defines a shaft bore 402 that receives the distal end of shaft 394. The shaft bore 402 may be coaxial or angled relative to the longitudinal axis of shaft sleeve 392, depending on whether angular adjustability is desired. Tangs 404 extend laterally outward beyond an outer surface of body 400 near to a proximal end of body 400 than a distal end.

Extension member 391 includes a cylindrical tubular body that has planar end surfaces 396 that are parallel to each other and normal to a longitudinal axis of extension member 391. Extension member 391 is interposed between a portion of shaft sleeve 392 and hosel 397 to distance those components by a predetermined length. In particular, the length of extension member 391 is selected for a desired spaced relation between shaft sleeve 392 and hosel 397. The length of extension member 391 is preferably in a range of about 0.125 inch to about 3.0 inches. A plurality of extension members 391 having different lengths may be provided so that the length of a golf club incorporating the system may be created. As a further alternative, planar end surfaces 396 may be non-parallel to each other so that wedge members having different lengths may be provided to adjust angular attributes and the length of the golf club.

In the assembled system 390, shaft sleeve 392 is inserted into extension member 391 and into hosel 397. It should be appreciated that the portion of shaft sleeve 392 extending into hosel 397, if any, is dependent on the length of extension member 391 and the desired range of length adjustment. Alignment features are included on shaft sleeve 392, extension member 391 and hosel 397 so that relative rotation between the components is prevented when the system is fully assembled and tightened. In the illustrated embodiment, the alignment features of shaft sleeve 392 include tangs 404 equally spaced circumferentially around shaft sleeve 392. Tangs 404 are sized and shaped to complement notches 406 included in a proximal end of extension member 391. The distal end of extension member 391 includes alignment features, e.g., tangs 408, that are sized and shaped to complement alignment features included in a proximal end of hosel 397, e.g., notches 410. In the assembled interchangeable shaft system 390, tangs 404 of shaft sleeve 392 are engaged with notches 406 of extension member 391 and tangs 408 of extension member 391 are engaged with notches 410 of hosel 397.

Fastener 399 extends through a portion of club head 393 and hosel 397 and engages a threaded aperture disposed in a distal head portion 412 of fastener extension 398. A shank portion 414 of fastener extension 398 extends proximally from head portion 412 and engages shaft sleeve 392. Preferably, head portion 412 has an outer diameter that is approximately equal to the inner diameter of hosel 397 so that engagement between head portion 412 and hosel 397 provides co-axial alignment between shaft sleeve 392 and hosel 397. It should be appreciated that a fastener having sufficient length to engage shaft sleeve 392 may be used rather than incorporating the intermediate fastener extension 398. In embodiments utilizing fastener extension 398, multiple fastener extensions may be provided that are constructed from different materials to provide swing weight adjustment and overall head weight adjustment. For example, the fastener extension may be constructed from any material that provides sufficient strength for impact such as titanium, steel, tungsten, aluminum, etc.

Figure 53:
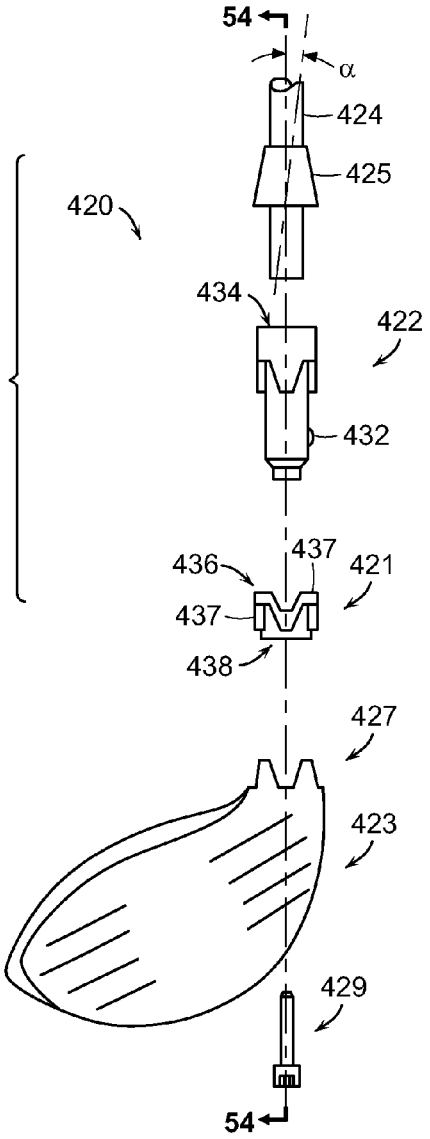
FIG. 53 is an exploded view of a golf club including another embodiment of the interchangeable shaft system of the present invention.
Figure 54:
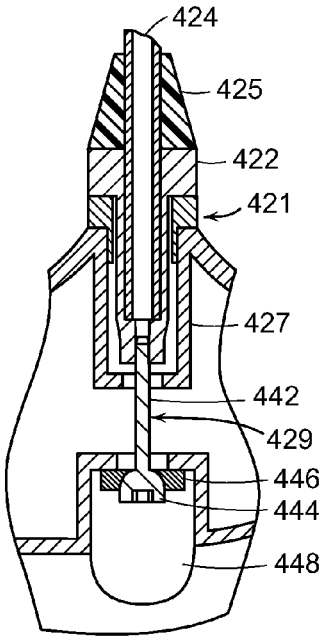
FIG. 54 is a cross-sectional view taken along line 54-54, shown in FIG. 53.
Figure 55:
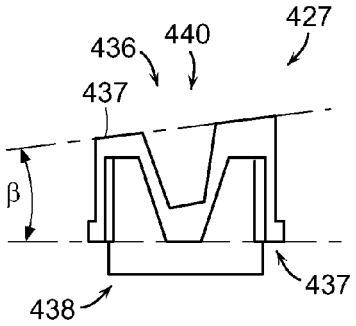
FIG. 55 is a side view of a wedge member included in the interchangeable shaft system of FIG. 53.

Referring to FIGS. 53-55, another embodiment of an interchangeable shaft system 420 including a wedge member 421 that is interposed between a shaft sleeve 422 and a hosel 427 of club head body 423 to provide dual angle adjustability, will be described. With the exception of the construction of retainer 432 and wedge member 421, the present embodiment is similar in construction to the embodiment of FIGS. 38-40.

Shaft sleeve 422 is coupled to a shaft 424, extends through wedge member 421 and is partially received within hosel 427. A fastener 429 releasably couples sleeve 422 to club head 423. A ferrule 425 is disposed on shaft 424 adjacent a proximal end of shaft sleeve 422.

Shaft sleeve 422 includes a shaft bore 434 that has a longitudinal axis that is not coaxial with the body of shaft sleeve 422. As a result, when shaft sleeve 422 is coupled to the distal end of shaft 424, the longitudinal axis of shaft sleeve 422 is angled (i.e., not coaxial) relative to the longitudinal axis of shaft 424 by shaft angle $\alpha$.

Wedge member 421 includes an alignment portion 436 and a support portion 438 Alignment portion 436 includes alignment features that extend outward from an outer surface of support portion 438. Opposite end surfaces 437 of alignment portion 436 of wedge member 421 are angled relative to each other so that when wedge member 421 is interposed between shaft sleeve 422 and hosel 427, the orientation of shaft 424 relative to club head 423 is defined by a combination of the positions of wedge member 421 relative to club head 423 and shaft sleeve 422 relative to club head 423.

End surfaces 437 are angled relative to each other by a wedge angle $\beta$ so that the surfaces are non-parallel and the alignment features extending away from those surfaces are angled relative to each other. In the present embodiment, a distal end surface of alignment portion 436 is generally normal to the longitudinal axis wedge member 421 and a bore 440 extending through wedge member 421 and a proximal end surface is angled relative to the longitudinal axis of wedge member 421 and bore 440. Bore 440 is sized to provide clearance for shaft sleeve 422 to extend through bore 440 and to be angled relative thereto.

Shaft sleeve 422 is inserted into wedge member 421 and into hosel 427 so that the three components have a desired relative orientation. The plurality of alignment features are included on shaft sleeve 422, wedge member 421 and hosel 427 so that a plurality of discrete orientations is provided. As described above, the magnitudes of shaft angle $\alpha$ and wedge angle $\beta$ and the location and number of alignment features are selected so that a desired range of motion and number of discrete orientations may be provided.

After shaft sleeve 422 is inserted into wedge member 421, retainer 432 is created on shaft sleeve 422 so that wedge member 421 is retained on shaft sleeve 422. Retainer 432 is a feature, such as a bump, that extends from an outer surface of shaft sleeve 422. Retainer 432 is sized so that it creates an effective outer diameter of shaft sleeve 422 that is greater than the diameter of bore 440 so that wedge member 421 is prevented from sliding past retainer 432 and off of shaft sleeve 422.

Fastener 429 includes a shank 442 and head 444. Head 444 includes a curved bearing surface that interfaces with a curved surface of a washer 446. The curved bearing surface of head 444 is free to slide against the curved surface of washer 446 while shaft sleeve 422 is oriented. Additionally, washer 446 is sized so that it is able to slide within fastener bore 448 during manipulation of the angular orientation of shaft sleeve 422 relative to the hosel.

Figure 56:
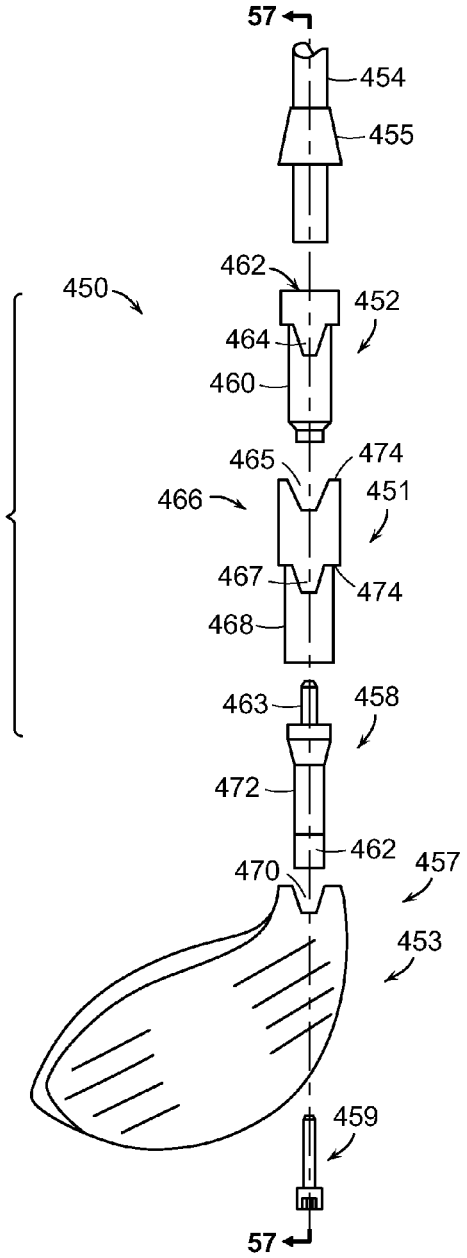
FIG. 56 is an exploded view of a golf club including another embodiment of the interchangeable shaft system of the present invention.
Figure 57:
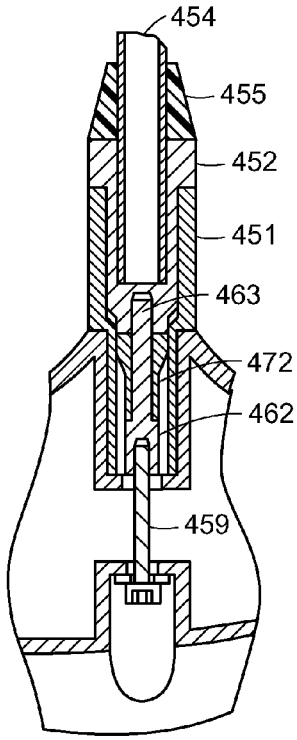
FIG. 57 is a cross-sectional view taken along line 57-57, shown in FIG. 56.

Referring to FIGS. 56 and 57, another embodiment of an interchangeable shaft system that provides overall club length adjustment will be described. In system 450, extension member 451 is substituted for a wedge member, but has a construction similar to wedge member 421 of system 420. System 450 includes a shaft sleeve 452 that is coupled to a shaft 454, and shaft sleeve 452 extends through extension member 451, which is partially received within a hosel 457 of club head 453. A fastener 459 releasably couples sleeve 452 to club head 453 through a fastener extension 458. A ferrule 455 is disposed on shaft 454 adjacent a proximal end of shaft sleeve 452.

Similar to other embodiments, shaft sleeve 452 includes a body 460 and a plurality of alignment features (e.g., tangs 464). Body 460 defines a shaft bore 462 that receives the distal end of shaft 454. The shaft bore 462 may be coaxial or angled relative to the longitudinal axis of shaft sleeve 452, depending on whether angular adjustability is desired. Tangs 464 extend laterally outward beyond an outer surface of body 460 nearer to a proximal end of body 460 than a distal end.

Extension member 451 includes an alignment portion 466 and a support portion 468. Alignment portion 466 includes alignment features that extend outward from an outer surface of support portion 468. Opposite end surfaces 474 of alignment portion 466 are parallel to each other and normal to a longitudinal axis of extension member 451. A portion of extension member 451 is interposed between a portion of shaft sleeve 452 and hosel 457 to distance those components by a predetermined length. In particular, the length of alignment portion 466 of extension member 451 is selected for a desired spaced relation between shaft sleeve 452 and hosel 457. The length of extension member 451 is preferably in a range of about 0.125 inch to about 3.00 inches. A plurality of extension members 451 having different lengths may be provided so that the length of a golf club incorporating the system may be adjusted.

Alignment features are included on shaft sleeve 452, alignment portion 466 and hosel 457 so that relative rotation between the components is prevented when the system is assembled and tightened. In the illustrated embodiment, the alignment features of shaft sleeve 452 include tangs 464 equally spaced circumferentially around shaft sleeve 452. Tangs 464 are sized and shaped to complement notches 465 included in a proximal end of extension member 451. The distal end of extension member 451 includes alignment features, e.g., tangs 467, that are sized and shaped to complement alignment features included in a proximal end of hosel 457, e.g., notches 470. In the assembled interchangeable shaft system 450, tangs 464 of shaft sleeve 452 are engaged with notches 465 of extension member 451 and tangs 467 of extension member 451 are engaged with notches 470 of hosel 457.

Fastener 459 extends through a portion of club head 453 and hosel 457 and engages a threaded aperture disposed in a distal head portion 462 of fastener extension 458. A shank portion 463 of fastener extension 458 extends proximally from head portion 462 and engages shaft sleeve 452. Preferably, head portion 462 has an outer diameter that is approximately equal to the inner diameter of hosel 457 so that engagement between head portion 462 and hosel 457 provides co-axial alignment between shaft sleeve 452 and hosel 457. It should be appreciated that a fastener having sufficient length to engage shaft sleeve 452 may be used rather than incorporating the intermediate fastener extension 458. In embodiments, utilizing fastener extension 458, multiple fastener extensions may be provided that are constructed from different materials to provide swing weight adjustment and overall head weight adjustment. For example, the fastener extension may be constructed from any material that provides sufficient strength for impact such as titanium, steel, tungsten, aluminum, etc.

A spacer 472 is also included on fastener extension 458. Spacer 472 extends from head portion 462 and along shank portion 463. A proximal portion of spacer 472 has an outer diameter that is approximately equal to a bore 474 of extension member 451 to maintain alignment of fastener 459 with hosel. Spacer 472 may be constructed from any material, such as polyurethane, ABS plastic, steel, aluminum, titanium or tungsten or combinations thereof to provide any desired weight.

Indicia may be provided on the shaft sleeve, wedge member, and/or hosel of a dual angle adjustable system. The indicia is provided to designate the orientation of the club head quantitatively, qualitatively or a combination thereof. The indicia may be included on any portion of the club head, shaft sleeve, shaft and/or wedge member of the assembled golf club. Preferably, indicia are provided on or adjacent the alignment features of the shaft sleeve, the wedge member and/or the hosel. The indicia may be engraved, raised, printed and/or painted and they may be one or more letters, numbers, symbols, dots and/or other markings that differentiate the available configurations of the golf club.

Figure 58A:
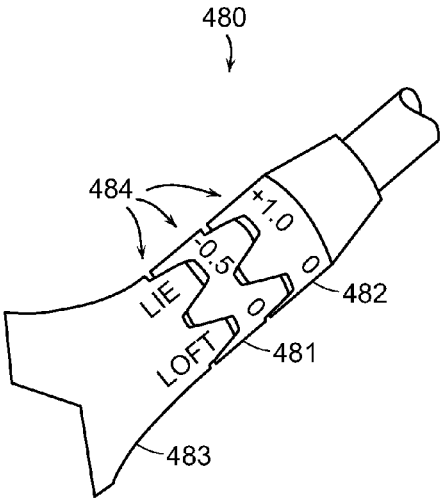
FIGS. 58A and 58B are perspective views of indicia provided on a portion of a golf club including an adjustable interchangeable shaft system.
Figure 58B:
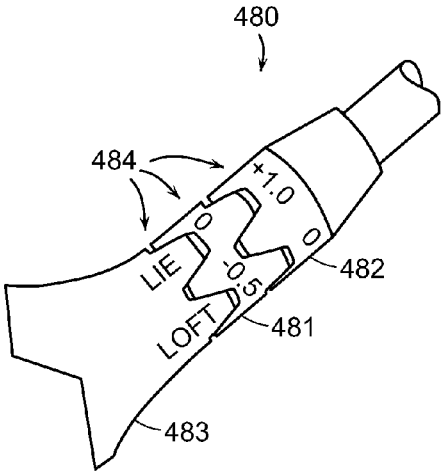

Referring to FIGS. 58A and 58B, interchangeable shaft system 480 includes indicia 484 that provide a visual, quantitative indication of the loft and lie orientation of a golf club. The configurations will be described with reference to the loft and lie orientations illustrated in FIG. 45. Quantitative indicia are particularly well-suited to systems in which the alignment features are configured so that the planes of maximum angular displacement of the wedge member and the shaft sleeve may be oriented approximately along 0° and 90° planes of the club head (i.e., planes D and/or F of FIG. 42) because the lie and loft planes more closely correspond to those alignment planes. System 480 includes a wedge member 481 that provides an angular displacement of about 0.5° and a shaft sleeve 482 that provides angular displacement of about 1.0°. In an example, a club head 483 is constructed so that it has a designed lie angle of about 58.5° and a designed loft angle of about 10.0°. Indicia 484 provide a user the ability to determine the adjusted loft and lie angle values. For example, the configuration of FIG. 58A corresponds to the golf club having an orientation shown by position D of zone 1, with a lie angle that is about 59.0°, as shown by the addition of the designed lie angle and the adjustment values provided by the indicia (e.g., 58.5°−0.5°+1.0°=59.0°) and a loft angle of about 10.0° (e.g., 10.0°+0.0°+0.0°=10.0°). The configuration of FIG. 58B corresponds to a golf club having an orientation shown by position C of zone 1, with a lie angle of about 59.5° (e.g., 58.5°+0.0°+1.0°) and a loft angle of about 9.5° (e.g., 10.0°−0.5°+0.0°).

Figure 59A:
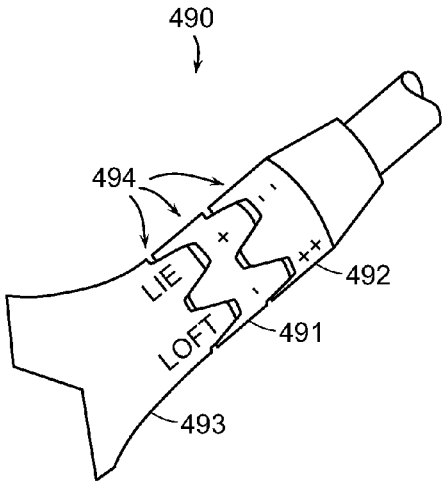
FIGS. 59A and 59B are perspective views of indicia provided on a portion of a golf club including an adjustable interchangeable shaft system.
Figure 59B:
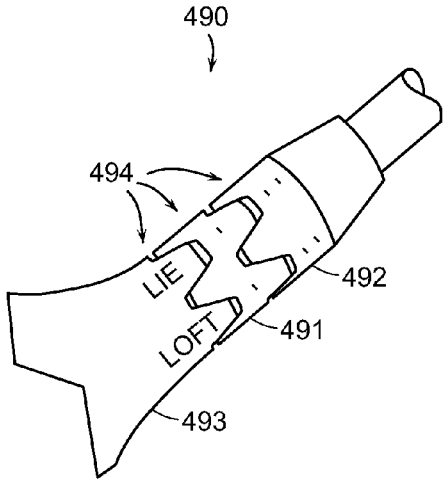

An example of qualitative indicia is illustrated in FIGS. 59A and 59B and will be described with reference to the loft and lie orientations illustrated in FIG. 47. An interchangeable shaft system 490 includes indicia 494 that provide a visual, qualitative indication of the loft and lie orientation of a golf club. Qualitative indicia are particularly well-suited to systems in which the alignment features are configured so that the planes of maximum angular displacement of the wedge member and shaft sleeve may be oriented approximately along 45° and 135° planes of the club head. System 490 includes a wedge member 491 that provides an angular displacement of about 0.5° and a shaft sleeve 492 that provides angular displacement of about 1.0°. Referring to FIG. 47, the position of shaft sleeve 492 relative to club head 493 determines within which of four zones the golf club orientation resides and the position of wedge member 491 relative to club head 493 determines which position within the zone corresponds to the golf club orientation. For example, the configuration of FIG. 59A corresponds to the golf club having loft and lie orientations that are shown by position B of zone 4. Utilizing club head 493 having a designed lie angle of about 58.5° and a designed loft angle of about 10.0°, that position corresponds to the golf club having a lie of about 58.15° and a loft of about 10.35°. The configuration of FIG. 59B, however, corresponds to the golf club having loft and lie orientations that are shown by position C of zone 3, which corresponds to a lie angle of about 57.45° and a loft angle of about 8.95°.

Figure 60A:
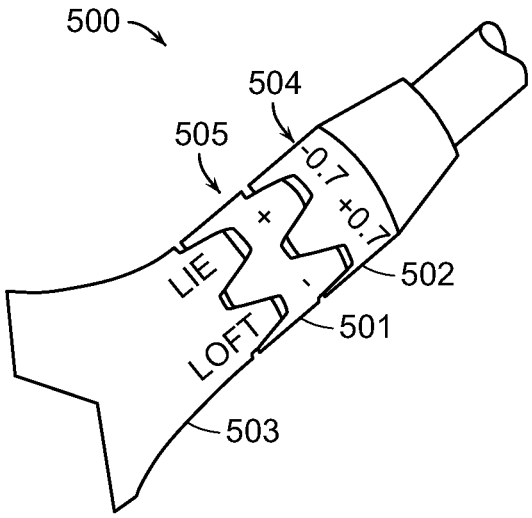
FIGS. 60A and 60B are perspective views of indicia provided on a portion of a golf club including an adjustable interchangeable shaft system.
Figure 60B:
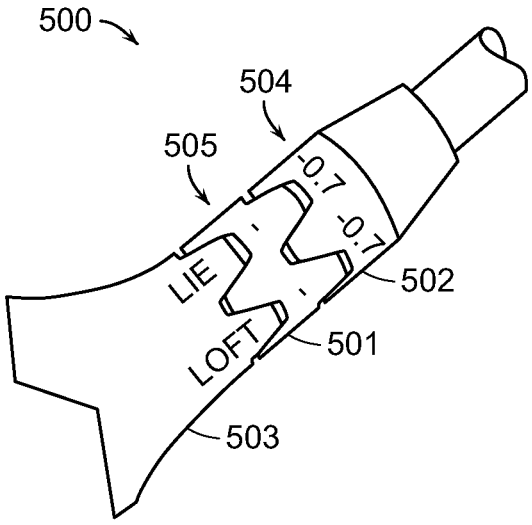

Another embodiment of indicia that combine both qualitative and quantitative information regarding the orientation of a club head 503 is shown in FIGS. 60A and 60B. In that embodiment, a system 500 includes quantitative indicia 504 on a shaft sleeve 502 and qualitative indicia 505 on a wedge member 501. The construction is otherwise identical to system 490. The configuration of FIG. 60A is the same as that of FIG. 59A, and the configuration of FIG. 60B is the same as that of FIG. 59B.

Various kits may be provided that include a golf club utilizing the adjustability of the interchangeable shaft system. In one kit, a golf club head, a shaft with a shaft sleeve and a plurality of wedge members are provided. Preferably, the magnitudes of the angular displacement of the shaft sleeve and one of the plurality of wedge members are identical so that a golf club can be configured with the nominal (i.e., designed) loft and lie. Another of the plurality of wedges has a magnitude of angular displacement that is different than the shaft sleeve so that a larger matrix of available loft and lie orientations is provided.

In another embodiment of the kit, at least one club head and a plurality of shaft assemblies are provided. The shaft assemblies each include a shaft, a shaft sleeve, and a wedge member. One of the shaft assemblies includes a wedge member having a magnitude of angular displacement that is either the same as the shaft sleeve or 0° (i.e., the wedge member is an extension member similar to those providing adjustable length) so that a neutral orientation is provided. A plurality of club heads may be provided having different designed angular attributes. Additionally, the shaft assemblies may be configured to provide different orientations of the planes of maximum displacement of the wedge member and shaft sleeve so that a rectangular or diamond-shaped matrix of loft and lie orientations may be provided. By providing a plurality of shaft assemblies or wedge members, the available loft and lie orientations for a golf club created from the kit becomes a composite of the loft and lie orientations available from each shaft assembly. As a result, a greater array of available orientations may be provided.

A golf club incorporating a dual angle adjustable interchangeable shaft system of the present invention may be used in a method of fitting. In one method, the golf club is provided in a neutral position and the user strikes one or more golf balls using the club. The ball flight characteristics are analyzed. A preferable loft and lie orientation zone is selected and the golf club is adjusted to provide a configuration within the selected zone. The user utilizes the club in that second configuration and the ball flight characteristics are analyzed. Preferably, a plurality of orientations within the selected zone are tested to determine a preferable loft and lie orientation for the user. In another method, the golf club is initially provided in at least one of the loft and lie orientations that is closest to the neutral, or design, loft and lie values and the remainder of the method steps described above are performed.

The embodiments of the present invention are illustrated with driver-type clubs. However, it should be understood that any type of golf club can utilize the inventive interchangeable shaft system. For example, an iron-type golf club may include an interchangeable shaft system, and further, the interchangeable shaft system may be configured to adjust the lie angle of the club. Additionally, the interchangeable shaft system can be used with non-golf equipment, such as fishing poles, aiming sights for firearms, plumbing, etc.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A golf club, comprising:

a golf club head including a fixed hosel and a fixed sole, wherein the entire sole is fixed;

an elongate shaft; and an interchangeable shaft system releasably coupling the shaft to the club head, wherein the interchangeable shaft system is configured to provide dual angle adjustability and comprises a single shaft tip sleeve assembly, wherein the interchangeable shaft system is configured to provide a plurality of coupling positions with each position producing a specific combination of a loft angle orientation and a lie angle orientation wherein the coupling positions include at least three positions having the same loft or lie angle orientation, wherein the single shaft tip sleeve assembly comprises an elongate sleeve member, a tubular member, and a retainer, wherein the elongate sleeve member comprises a sleeve body, wherein the tubular member defines a sleeve bore, wherein the retainer is coupled to the sleeve member, wherein a portion of the sleeve member that is located between a first end portion of the sleeve member and the portion where the retainer is coupled to the sleeve member is received in the sleeve bore of the tubular member, and wherein the retainer extends away from an outer surface of the sleeve body such that the tubular member is retained on the sleeve member when the shaft tip assembly is separate from the golf club head.

2. The golf club of claim 1, wherein the first end portion of the sleeve member includes a plurality of tangs.

3. The golf club of claim 1, wherein the tubular member includes a plurality of alignment features including a plurality of tangs disposed at proximal and distal ends of the tubular member.

4. The golf club of claim 1, wherein the tubular member is a wedge member that is interposed between the sleeve member and a portion of the golf club head, wherein the wedge member defines a maximum angular deflection plane and a wedge angle.

5. The golf club of claim 4, wherein the sleeve member defines a shaft angle.

6. The golf club of claim 5, wherein a magnitude of the wedge angle is different than a magnitude of the shaft angle.

7. A golf club, comprising:

a golf club head;

an elongate shaft; and an interchangeable shaft system releasably coupling the shaft to the club head, wherein the interchangeable shaft system is configured to provide dual angle adjustability, and wherein the interchangeable shaft system is configured to provide a plurality of coupling positions with each position producing a specific combination of a loft angle orientation and a lie angle orientation wherein the coupling positions include at least three positions having the same loft or lie angle orientation, wherein the interchangeable shaft system comprises a shaft tip sleeve assembly comprising an elongate sleeve member, a tubular member, and a retainer, wherein the elongate sleeve member comprises a sleeve body, wherein the tubular member defines a sleeve bore, wherein the retainer is coupled to the sleeve member, wherein a portion of the sleeve member that is located between a first end portion of the sleeve member and the portion where the retainer is coupled to the sleeve member is received in the sleeve bore of the tubular member, and wherein the retainer extends away from an outer surface of the sleeve body such that the tubular member is retained on the sleeve member when the shaft tip assembly is separate from the golf club head.

8. The golf club of claim 7, wherein the first end portion of the sleeve member includes a plurality of tangs.

9. The golf club of claim 7, wherein the tubular member includes a plurality of alignment features including a plurality of tangs disposed at proximal and distal ends of the tubular member.

10. The golf club of claim 7, wherein the tubular member is a wedge member that is interposed between the sleeve member and a portion of the golf club head, wherein the wedge member defines a maximum angular deflection plane and a wedge angle.

11. The golf club of claim 10, wherein the sleeve member defines a shaft angle.

12. The golf club of claim 11, wherein a magnitude of the wedge angle is different than a magnitude of the shaft angle.

* * * * *